US008093342B2

(12) United States Patent
Minami et al.

(10) Patent No.: US 8,093,342 B2
(45) Date of Patent: Jan. 10, 2012

(54) POLYMER, CHARGE CONTROL AGENT, AND TONER FOR DEVELOPING ELECTROSTATIC LATENT IMAGES

(75) Inventors: Masato Minami, Yokohama (JP); Tatsuki Fukui, Yokohama (JP); Takashi Kenmoku, Mishima (JP); Tetsuya Yano, Tokyo (JP); Takeshi Ikeda, Suntoh-gun (JP); Norikazu Fujimoto, Susono (JP); Atsushi Tani, Suntoh-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 12/842,229

(22) Filed: Jul. 23, 2010

(65) Prior Publication Data

US 2010/0291482 A1 Nov. 18, 2010

Related U.S. Application Data

(62) Division of application No. 11/558,222, filed on Nov. 9, 2006, now abandoned.

(30) Foreign Application Priority Data

Nov. 11, 2005 (JP) ..... 2005-328165

(51) Int. Cl.
*G03G 9/06* (2006.01)
*G03G 9/135* (2006.01)

(52) U.S. Cl. ..... 526/287; 430/108.5

(58) Field of Classification Search ..... 526/287; 430/108.5

See application file for complete search history.

(56) References Cited

U.S. PATENT DOCUMENTS

| | | | | |
|---|---|---|---|---|
| 2005/0287463 | A1 | 12/2005 | Fukui et al. | 430/111.35 |
| 2006/0035098 | A1 | 2/2006 | Fukui et al. | 428/522 |
| 2007/0059627 | A1 | 3/2007 | Fukui et al. | 430/110.3 |
| 2008/0118854 | A1 | 5/2008 | Fujimoto et al. | 430/108.22 |
| 2009/0162773 | A1 | 6/2009 | Fukui et al. | 430/108.2 |

FOREIGN PATENT DOCUMENTS

| | | | |
|---|---|---|---|
| JP | 60-093429 | | 5/1985 |
| JP | 09-141807 | | 6/1997 |
| JP | 9171271 | | 6/1997 |
| JP | 2005070520 | A * | 3/2005 |

OTHER PUBLICATIONS

J. Polymer Sci., Polymer Chem. Ed., 19, 8, Aug. 1981, pp. 1995-2006.

Padmapriya, A.A., et al., "A New Method for the Esterification of Sulphonic Acids", Synthetic Comm., 15(12), 1057-1062 (1985).

Tanaka et al., "Poly[2-(1-naphthyl)ethyl-p-styrenesulfonate] as polymeric derivatizing reagent for liquid chromatography of fatty acids", Fresenius Z Anal Chem 335:311-312 (1989).

* cited by examiner

*Primary Examiner* — Ling Choi
*Assistant Examiner* — Chun-Cheng Wang
(74) *Attorney, Agent, or Firm* — Fitzpatrick, Cella, Harper & Scinto

(57) ABSTRACT

Provided are a novel polymer having a sulfonic group, a sulfonic acid ester group, or a derivative thereof incorporated therein, a method of producing the polymer, and a novel compound suitable for producing the polymer. A polymer is characterized by containing a unit represented by the following formula (1):

(1)

wherein $R_{1w}$ and $R_{1x}$ are each independently a halogen atom or a hydrogen atom, $R_{1y}$ is a $CH_3$ group or a hydrogen atom, and any one of $R_{1a}$, $R_{1b}$, and $R_{1c}$ is a sulfonate group represented by $SO_3R_{1f}$.

6 Claims, 1 Drawing Sheet

FIGURE
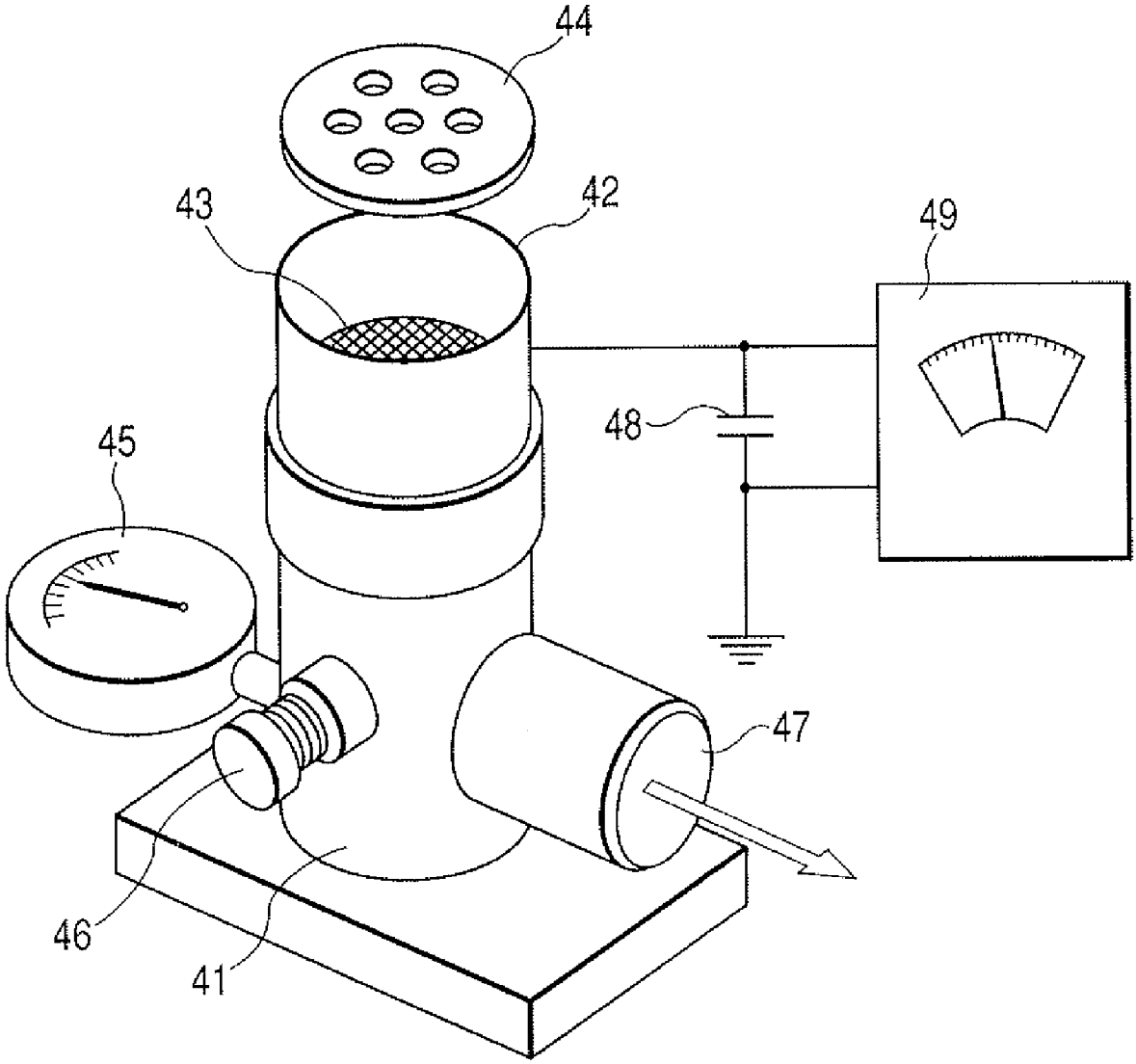

POLYMER, CHARGE CONTROL AGENT, AND TONER FOR DEVELOPING ELECTROSTATIC LATENT IMAGES

CROSS-REFERENCE TO RELATED APPLICATION

This application is a division of U.S. patent application Ser. No. 11/558,222, filed on Nov. 9, 2006, which claims the benefit of Japanese Patent Application No. 2005-328165, filed on Nov. 11, 2005. The contents of the aforementioned applications are incorporated herein by reference in their entireties.

BACKGROUND OF THE INVENTION

1. Field of the Invention

The present invention relates to: a novel polymer having a sulfonic group, a sulfonic acid ester group, or a derivative thereof; a method of producing the same; and a novel compound suitable for producing the polymer. The present invention also relates to a frictional charging member for electrophotography such as toner, a carrier, and a sleeve.

2. Description of Related Art

A polymer having a hydrophilic group such as a sulfonic group is expected to find use in a wide variety of applications. In addition, the synthesis of such a polymer containing a sulfonic group is generally limited to the synthesis involving the use of a specific vinyl monomer containing a sulfonic functional group. Specific examples of the monomer include sulfonated styrene and 2-acrylamide-2-methylpropanesulfonic acid (AMPS).

Japanese Patent No. 2979222 discloses a charge control agent composed of a copolymer of a styrene sulfonic acid salt and a vinyl monomer that is copolymerizable therewith, and a negatively chargeable electrophotographic toner using the charge control agent.

SUMMARY OF THE INVENTION

Sulfonated styrene and AMPS alone do not suffice to meet the demand for application to various uses, so the provision of a novel polymer has been desired. An object of the present invention is to provide a novel polymer having a sulfonic group, a sulfonic acid ester group, or a derivative thereof introduced therein, and a method of producing the polymer. Another object of the present invention is to provide a novel compound suitable for producing the polymer, and a charge control agent using the polymer.

In view of the foregoing, the present inventors have made extensive studies with a view to developing a novel polymer into which a hydrophilic group or a polar group is introduced, the novel polymer being considered to be useful for improving various functions. As a result, the inventors have reached the following invention.

A polymer according to a first aspect of the present invention is a polymer comprising a unit represented by the chemical formula (1):

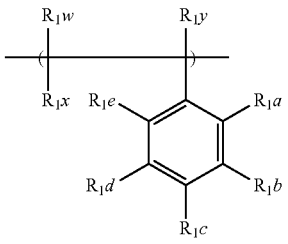

(1)

wherein $R_{1w}$, $R_{1x}$, and $R_{1y}$ are selected from the following (i), (ii) and (iii); $R_{1w}$ and $R_{1x}$ are each independently a halogen atom or a hydrogen atom; and $R_{1y}$ is a $CH_3$ group or a hydrogen atom.

In the case of the following (i), $R_{1a}$, $R_{1b}$, $R_{1c}$, $R_{1d}$, and $R_{1e}$ are selected from a combination defined in any one of the following (i-A), (i-B) and (i-C); in the case of the following (ii), $R_{1a}$, $R_{1b}$, $R_{1c}$, $R_{1d}$, and $R_{1e}$ are selected from a combination defined in any one of the following (ii-A), (ii-B) and (ii-C); and in the case of the following (iii), $R_{1a}$, $R_{1b}$, $R_{1c}$, $R_{1d}$, and $R_{1e}$ are selected from a combination defined in any one of the following (iii-A), (iii-B) and (iii-C):

(i) when $R_{1w}$, $R_{1x}$, and $R_{1y}$ are each a hydrogen atom:

(i-A) $R_{1a}$ is $SO_3R_{1f}$ wherein $R_{1f}$ is a linear alkyl group having 1 to 8 carbon atoms, a branched alkyl group having 3 or 5 to 8 carbon atoms, or a substituted or unsubstituted phenyl group; and $R_{1b}$, $R_{1c}$, $R_{1d}$, and $R_{1e}$ are each a hydrogen atom; or alternatively, $R_{1a}$ is $SO_3R_{1f}$ wherein $R_{1f}$ is a linear or branched alkyl group having 1 to 8 carbon atoms, a substituted or unsubstituted aromatic ring structure, or a substituted or unsubstituted heterocyclic ring structure; and $R_{1b}$, $R_{1c}$, $R_{1d}$, and $R_{1e}$ are each independently a linear or branched alkyl group having 1 to 8 carbon atoms, a linear or branched alkoxyl group having 1 to 8 carbon atoms, or a hydrogen atom with the proviso that a case where all of $R_{1b}$, $R_{1c}$, $R_{1d}$, and $R_{1e}$ are hydrogen atoms is excluded, (i-B) $R_{1b}$ is $SO_3R_{1g}$ wherein $R_{1g}$ is a linear or branched alkyl group having 1 to 8 carbon atoms, a substituted or unsubstituted aromatic ring structure, or a substituted or unsubstituted heterocyclic ring structure; and $R_{1a}$, $R_{1c}$, $R_{1d}$, and $R_{1e}$ are each independently a hydrogen atom, a linear or branched alkyl group having 1 to 8 carbon atoms, or a linear or branched alkoxyl group having 1 to 8 carbon atoms, or (i-C) $R_{1c}$ is $SO_3R_{1h}$ wherein $R_{1h}$ is a branched alkyl group having 5 to 8 carbon atoms, a linear alkyl group having 7 carbon atoms, a substituted or unsubstituted aromatic ring structure, or a substituted or unsubstituted heterocyclic ring structure; and $R_{1a}$, $R_{1b}$, $R_{1d}$, and $R_{1e}$ are each a hydrogen atom; or alternatively, $R_{1c}$ is $SO_3R_{1g}$ wherein $R_{1g}$ is a linear or branched alkyl group having 1 to 8 carbon atoms, a substituted or unsubstituted aromatic ring structure, or a substituted or unsubstituted heterocyclic ring structure; and $R_{1a}$, $R_{1b}$, $R_{1d}$, and $R_{1e}$ are each independently a linear or branched alkyl group having 1 to 8 carbon atoms or a linear or branched alkoxyl group having 1 to 8 carbon atoms with the proviso that a case where all of $R_{1a}$, $R_{1b}$, $R_{1d}$, and $R_{1e}$ are hydrogen atoms is excluded;

(ii) when $R_{1w}$ and $R_{1x}$ are each a hydrogen atom and $R_{1y}$ is a $CH_3$ group:

(ii-A) $R_{1a}$ is $SO_3R_{1g}$ wherein $R_{1g}$ is a linear or branched alkyl group having 1 to 8 carbon atoms, a substituted or unsubstituted aromatic ring structure, or a substituted or unsubstituted heterocyclic ring structure; and $R_{1b}$, $R_{1c}$, $R_{1d}$ and $R_{1e}$ are each independently a hydrogen atom, a linear or branched alkyl group having 1 to 8 carbon atoms, or a linear or branched alkoxyl group having 1 to 8 carbon atoms, (ii-B) $R_{1b}$ is $SO_3R_{1g}$ wherein $R_{1g}$ is a linear or branched alkyl group having 1 to 8 carbon atoms, a substituted or unsubstituted aromatic ring structure, or a substituted or unsubstituted heterocyclic ring structure; and $R_{1a}$, $R_{1c}$, $R_{1d}$, and $R_{1e}$ are each independently a hydrogen atom, a linear or branched alkyl group having 1 to 8 carbon atoms, or a linear or branched alkoxyl group having 1 to 8 carbon atoms, or (ii-C) $R_{1c}$ is $SO_3R_{1i}$ wherein $R_{1i}$ is a linear or branched alkyl group having 2 to 8 carbon atoms, a substituted or unsubstituted aromatic ring structure, or a substituted or unsubstituted heterocyclic ring structure; and $R_{1a}$, $R_{1b}$, $R_{1d}$, and $R_{1e}$ are each a hydrogen atom; or alternatively, $R_{1c}$ is $SO_3R_{1g}$ wherein $R_{1g}$ is a linear or branched alkyl group having 1 to 8 carbon atoms, a substituted or unsubstituted aromatic ring structure, or a substituted or unsubstituted heterocyclic ring structure; and $R_{1a}$, $R_{1b}$, $R_{1d}$, and $R_{1e}$ are each independently a linear or branched alkyl group having 1 to 8 carbon atoms, or a linear or branched alkoxyl group having 1 to 8 carbon atoms; and (iii) when at least one of $R_{1w}$ and $R_{1x}$ is a halogen atom:

(iii-A) $R_{1a}$ is $SO_3R_{1j}$ wherein $R_{1j}$ is a hydrogen atom, a linear or branched alkyl group having 1 to 8 carbon atoms, a substituted or unsubstituted aromatic ring structure, or a substituted or unsubstituted heterocyclic ring structure; and $R_{1b}$, $R_{1c}$, $R_{1d}$, and $R_{1e}$ are each independently a hydrogen atom, a linear or branched alkyl group having 1 to 8 carbon atoms, or a linear or branched alkoxyl group having 1 to 8 carbon atoms, (iii-B) $R_{1b}$ is $SO_3R_{1j}$ wherein $R_{1j}$ is a hydrogen atom, a linear or branched alkyl group having 1 to 8 carbon atoms, a substituted or unsubstituted aromatic ring structure, or a substituted or unsubstituted heterocyclic ring structure; and $R_{1a}$, $R_{1c}$, $R_{1d}$, and $R_{1e}$ are each independently a hydrogen atom, a linear or branched alkyl group having 1 to 8 carbon atoms, or a linear or branched alkoxyl group having 1 to 8 carbon atoms, or (iii-C) $R_{1c}$ is $SO_3R_{1g}$ wherein $R_{1g}$ is a linear or branched alkyl group having 1 to 8 carbon atoms, a substituted or unsubstituted aromatic ring structure, or a substituted or unsubstituted heterocyclic ring structure; and $R_{1a}$, $R_{1b}$, $R_{1d}$, and $R_{1e}$ are each independently a hydrogen atom, a linear or branched alkyl group having 1 to 8 carbon atoms, or a linear or branched alkoxyl group having 1 to 8 carbon atoms.

A polymer according to a second aspect of the present invention is a polymer including a unit represented by the chemical formula (2):

(2)

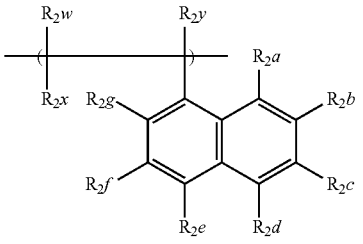

wherein $R_{2w}$ and $R_{2x}$ are each independently a halogen atom or a hydrogen atom; $R_{2y}$ is a $CH_3$ group or a hydrogen atom; $R_{2a}$, $R_{2b}$, $R_{2c}$, $R_{2d}$, $R_{2e}$, $R_{2f}$, and $R_{2g}$ are each independently $SO_3R_{2h}$ wherein $R_{2h}$ is a hydrogen atom, a linear or branched alkyl group having 1 to 8 carbon atoms, a substituted or unsubstituted aromatic ring structure, or a substituted or unsubstituted heterocyclic ring structure, a hydrogen atom, a linear or branched alkyl group having 1 to 8 carbon atoms, or a linear or branched alkoxyl group having 1 to 8 carbon atoms, and at least one of $R_{2a}$, $R_{2b}$, $R_{2c}$, $R_{2d}$, $R_{2e}$, $R_{2f}$, and $R_{2g}$ is $SO_3R_{2h}$; or $R_{2e}$ is $SO_3R_{2i}$ wherein $R_{2i}$ is a linear or branched alkyl group having 1 to 8 carbon atoms, a substituted or unsubstituted aromatic ring structure, or a substituted or unsubstituted heterocyclic ring structure, and $R_{2a}$, $R_{2b}$, $R_{2c}$, $R_{2d}$, $R_{2f}$, and $R_{2g}$ are each independently a hydrogen atom, a linear or branched alkyl group having 1 to 8 carbon atoms, or a linear or branched alkoxyl group having 1 to 8 carbon atoms.

A polymer according to a third aspect of the present invention is a polymer including a unit represented by the chemical formula (3):

(3)

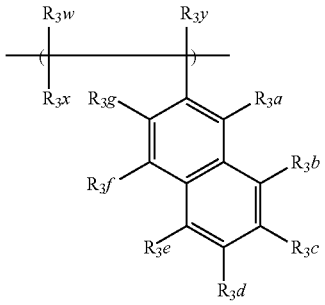

wherein $R_{3w}$ and $R_{3x}$ are each independently a halogen atom or a hydrogen atom; $R_{3y}$ is a $CH_3$ group or a hydrogen atom; $R_{3a}$, $R_{3b}$, $R_{3c}$, $R_{3d}$, $R_{3e}$, $R_{3f}$, and $R_{3g}$ are each independently $SO_3R_{3h}$ wherein $R_{3h}$ is a hydrogen atom, a linear or branched alkyl group having 1 to 8 carbon atoms, a substituted or unsubstituted aromatic ring structure, or a substituted or unsubstituted heterocyclic ring structure, a hydrogen atom, a linear or branched alkyl group having 1 to 8 carbon atoms, or a linear or branched alkoxyl group having 1 to 8 carbon atoms, and at least one of $R_{3a}$, $R_{3b}$, $R_{3c}$, $R_{3d}$, $R_{3e}$, $R_{3f}$, and $R_{3g}$ is $SO_3R_{3h}$.

A monomer for producing the polymer according to a first aspect of the present invention is a compound represented by the chemical formula (5):

(5)

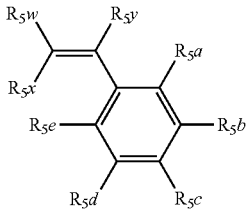

wherein $R_{5x}$, $R_{5y}$, and $R_{5w}$ are selected from the following (i), (ii) and (iii); $R_{5w}$ and $R_{5x}$ are each independently a halogen atom or a hydrogen atom; $R_{5y}$ is a $CH_3$ group or a hydrogen atom; and in the case of the following (i), $R_{5a}$, $R_{5b}$, $R_{5c}$, $R_{5d}$, and $R_{5e}$ are selected from a combination defined in any one of the following (i-A), (i-B) and (i-C); in the case of the following (ii), $R_{5a}$, $R_{5b}$, $R_{5c}$, $R_{5d}$, and $R_{5e}$ are selected from a combination defined in any one of the following (ii-A), (ii-B) and (ii-C); and in the case of the following (iii), $R_{5a}$, $R_{5b}$, $R_{5c}$, $R_{5d}$, and $R_{5e}$ are selected from a combination defined in any one of the following (iii-A), (iii-B) and (iii-C):

(i) when $R_{5w}$, $R_{5x}$, and $R_{5y}$ are each a hydrogen atom:

(i-A) $R_{5a}$ is $SO_3R_{5f}$ wherein $R_{5f}$ is a linear alkyl group having 1 to 8 carbon atoms, a branched alkyl group having 3 or 5 to 8 carbon atoms, a substituted or unsubstituted aromatic ring structure, or a substituted or unsubstituted heterocyclic ring structure; and $R_{5b}$, $R_{5c}$, $R_{5d}$, and $R_{5e}$ are each a hydrogen atom; or $R_{5a}$ is $SO_3R_{5g}$ wherein $R_{5g}$ is a linear or branched alkyl group having 1 to 8 carbon atoms, a substituted or unsubstituted aromatic ring structure, or a substituted or unsubstituted heterocyclic ring structure, and $R_{5b}$, $R_{5c}$, $R_{5d}$, and $R_{5e}$ are each independently a linear or branched alkyl group having 1 to 8 carbon atoms, a linear or branched alkoxyl group having 1 to 8 carbon atoms, or a hydrogen atom with the proviso that a case where all of $R_{5b}$, $R_{5c}$, $R_{5d}$, and $R_{5e}$ are hydrogen atoms is excluded, (i-B) $R_{5b}$ is $SO_3R_{5g}$ wherein $R_{5g}$ is a linear or branched alkyl group having 1 to 8 carbon atoms, a substituted or unsubstituted aromatic ring structure, or a substituted or unsubstituted heterocyclic ring structure; and $R_{5a}$, $R_{5c}$, $R_{5d}$, and $R_{5e}$ are each independently a hydrogen atom, a linear or branched alkyl group having 1 to 8 carbon atoms, or a linear or branched alkoxyl group having 1 to 8 carbon atoms, or (i-C) $R_{5c}$ is $SO_3R_{5h}$ wherein $R_{5h}$ is a branched alkyl group having 5 to 8 carbon atoms, a linear alkyl group having 7 carbon atoms, a substituted or unsubstituted aromatic ring structure, or a substituted or unsubstituted heterocyclic ring structure; and $R_{5a}$, $R_{5b}$, $R_{5d}$, and $R_{5e}$ are each a hydrogen atom; or $R_{5c}$ is $SO_3R_{5g}$ wherein $R_{5g}$ is a linear or branched alkyl group having 1 to 8 carbon atoms, a substituted or unsubstituted aromatic ring structure, or a substituted or unsubstituted heterocyclic ring structure, and $R_{5a}$, $R_{5b}$, $R_{5d}$, and $R_{5e}$ are each independently a linear or branched alkyl group having 1 to 8 carbon atoms, a linear or branched alkoxyl group having 1 to 8 carbon atoms, or a hydrogen atom with the proviso that a case where all of $R_{5a}$, $R_{5b}$, $R_{5d}$, and $R_{5e}$ are hydrogen atoms is excluded;

(ii) when $R_{5w}$ and $R_{5x}$ are each a hydrogen atom and $R_{5y}$ is a $CH_3$ group:

(ii-A) $R_{5a}$ is $SO_3R_{5f}$ wherein $R_{5f}$ is a linear or branched alkyl group having 1 to 8 carbon atoms, a substituted or unsubstituted aromatic ring structure, or a substituted or unsubstituted heterocyclic ring structure; and $R_{5b}$, $R_{5c}$, $R_{5d}$, and $R_{5e}$ are each independently a hydrogen atom, a linear or branched alkyl group having 1 to 8 carbon atoms, or a linear or branched alkoxyl group having 1 to 8 carbon atoms, (ii-B) $R_{5b}$ is $SO_3R_{5g}$ wherein $R_{5g}$ is a linear or branched alkyl group having 1 to 8 carbon atoms, a substituted or unsubstituted aromatic ring structure, or a substituted or unsubstituted heterocyclic ring structure; and $R_{5a}$, $R_{5c}$, $R_{5d}$, and $R_{5e}$ are each a hydrogen atom, a linear or branched alkyl group having 1 to 8 carbon atoms, or a linear or branched alkoxyl group having 1 to 8 carbon atoms, or (ii-C) $R_{5c}$ is $SO_3R_{5i}$ wherein $R_{5i}$ is a linear or branched alkyl group having 2 to 8 carbon atoms, a substituted or unsubstituted aromatic ring structure, or a substituted or unsubstituted heterocyclic ring structure; and $R_{5a}$, $R_{5b}$, $R_{5d}$, and $R_{5e}$ are each a hydrogen atom; or $R_{5c}$ is $SO_3R_{5g}$ wherein $R_{5g}$ is a linear or branched alkyl group having 1 to 8 carbon atoms, a substituted or unsubstituted aromatic ring structure, or a substituted or unsubstituted heterocyclic ring structure, and $R_{5a}$, $R_{5b}$, $R_{5d}$, and $R_{5e}$ are each a linear or branched alkyl group having 1 to 8 carbon atoms, or a linear or branched alkoxyl group having 1 to 8 carbon atoms; and (iii) when at least one of $R_{5w}$ and $R_{5x}$ is a halogen atom:

(iii-A) $R_{5a}$ is $SO_3R_{5j}$ wherein $R_{5j}$ is a hydrogen atom, a linear or branched alkyl group having 1 to 8 carbon atoms, a substituted or unsubstituted aromatic ring structure, or a substituted or unsubstituted heterocyclic ring structure; and $R_{5b}$, $R_{5c}$, $R_{5d}$, and $R_{5e}$ are each independently a hydrogen atom, a linear or branched alkyl group having 1 to 8 carbon atoms, or a linear or branched alkoxyl group having 1 to 8 carbon atoms, (iii-B) $R_{5b}$ is $SO_3R_{5j}$ wherein $R_{5j}$ is a hydrogen atom, a linear or branched alkyl group having 1 to 8 carbon atoms, a substituted or unsubstituted aromatic ring structure, or a substituted or unsubstituted heterocyclic ring structure; and $R_{5a}$, $R_{5c}$, $R_{5d}$, and $R_{5e}$ are each a hydrogen atom, a linear or branched alkyl group having 1 to 8 carbon atoms, or a linear or branched alkoxyl group having 1 to 8 carbon atoms, or (iii-C) $R_{5c}$ is $SO_3R_{5g}$ wherein $R_{5g}$ is a linear or branched alkyl group having 1 to 8 carbon atoms, a substituted or unsubstituted aromatic ring structure, or a substituted or unsubstituted heterocyclic ring structure; and $R_{5a}$, $R_{5b}$, $R_{5d}$, and $R_{5e}$ are each independently a hydrogen atom, a linear or branched alkyl group having 1 to 8 carbon atoms, or a linear or branched alkoxyl group having 1 to 8 carbon atoms.

A monomer for producing the polymer according to a second aspect of the present invention is a compound represented by the chemical formula (6):

(6)

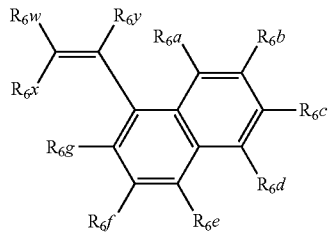

wherein $R_{6w}$ and $R_{6x}$ are each independently a halogen atom or a hydrogen atom; $R_{6y}$ is a $CH_3$ group or a hydrogen atom; $R_{6a}$, $R_{6b}$, $R_{6c}$, $R_{6d}$, $R_{6e}$, $R_{6f}$, and $R_{6g}$ are each independently $SO_3R_{6h}$ wherein $R_{6h}$ is a hydrogen atom, a linear or branched alkyl group having 1 to 8 carbon atoms, a substituted or unsubstituted aromatic ring structure, or a substituted or unsubstituted heterocyclic ring structure, a hydrogen atom, a linear or branched alkyl group having 1 to 8 carbon atoms, or a linear or branched alkoxyl group having 1 to 8 carbon atoms, and at least one of $R_{6a}$, $R_{6b}$, $R_{6c}$, $R_{6d}$, $R_{6e}$, $R_{6f}$, and $R_{6g}$ is $SO_3R_{6h}$; or $R_{6e}$ is $SO_3R_{6i}$ wherein $R_{6i}$ is a linear or branched alkyl group having 1 to 8 carbon atoms, a substituted or unsubstituted aromatic ring structure, or a substituted or unsubstituted heterocyclic ring structure, and $R_{6a}$, $R_{6b}$, $R_{6c}$, $R_{6d}$, $R_{6f}$, and $R_{6g}$ are each independently a hydrogen atom, a linear or branched alkyl group having 1 to 8 carbon atoms, or a linear or branched alkoxyl group having 1 to 8 carbon atoms.

A monomer for producing the polymer according to a third aspect of the present invention is a compound represented by the chemical formula (7):

(7)

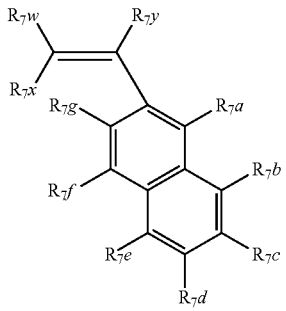

wherein $R_{7w}$ and $R_{7x}$ are each independently a halogen atom or a hydrogen atom; $R_{7y}$ is a $CH_3$ group or a hydrogen atom; $R_{7a}$, $R_{7b}$, $R_{7c}$, $R_{7d}$, $R_{7e}$, $R_{7f}$, and $R_{7g}$ are each independently $SO_3R_{7h}$ wherein $R_{7h}$ is a hydrogen atom, a linear or branched alkyl group having 1 to 8 carbon atoms, a substituted or unsubstituted aromatic ring structure, or a substituted or unsubstituted heterocyclic ring structure, a hydrogen atom, a linear or branched alkyl group having 1 to 8 carbon atoms, or a linear or branched alkoxyl group having 1 to 8 carbon atoms, and any one of $R_{7a}$, $R_{7b}$, $R_{7c}$, $R_{7d}$, $R_{7e}$, $R_{7f}$, and $R_{7g}$ is $SO_3R_{7h}$.

A charge control agent according to a first aspect of the present invention is a charge control agent for controlling a charging state of fine particles, which comprises a polymer having a unit represented by the chemical formula (8):

(8)

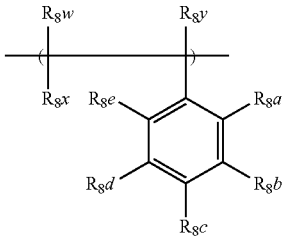

wherein $R_{8w}$ and $R_{8x}$ are each independently a halogen atom or a hydrogen atom; $R_{8y}$, is a $CH_3$ group or a hydrogen atom; $R_{8a}$, $R_{8b}$, $R_{8c}$, $R_{8d}$, and $R_{8e}$ are each independently $SO_3R_{8f}$ wherein $R_{8f}$ is a linear or branched alkyl group having 1 to 8 carbon atoms, a substituted or unsubstituted aromatic ring structure, or a substituted or unsubstituted heterocyclic ring structure, a hydrogen atom, a linear or branched alkyl group having 1 to 8 carbon atoms, or a linear or branched alkoxyl group having 1 to 8 carbon atoms, and at least one of $R_{8a}$, $R_{8b}$, $R_{8c}$, $R_{8d}$, and $R_{8e}$ is $SO_3R_{8f}$.

A charge control agent according to a second aspect of the present invention is a charge control agent for controlling a charging state of fine particles, which comprises a polymer having a unit represented by the chemical formula (9):

(9)

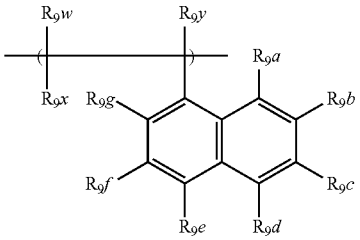

wherein $R_{9w}$ and $R_{9x}$ are each independently a halogen atom or a hydrogen atom; $R_{9y}$ is a $CH_3$ group or a hydrogen atom; $R_{9a}$, $R_{9b}$, $R_{9c}$, $R_{9d}$, $R_{9e}$, $R_{9f}$, and $R_{9g}$ are each independently $SO_3R_{9h}$ wherein $R_{9h}$ is a hydrogen atom, a linear or branched alkyl group having 1 to 8 carbon atoms, a substituted or unsubstituted aromatic ring structure, or a substituted or unsubstituted heterocyclic ring structure, a hydrogen atom, a linear or branched alkyl group having 1 to 8 carbon atoms, or a linear or branched alkoxyl group having 1 to 8 carbon atoms, and at least one of $R_{9a}$, $R_{9b}$, $R_{9c}$, $R_{9d}$, $R_{9e}$, $R_{9f}$, and $R_{9g}$ is $SO_3R_{9h}$.

A charge control agent according to a third aspect of the present invention is a charge control agent for controlling a charging state of fine particles, which comprises a polymer having a unit represented by the chemical formula (10):

(10)

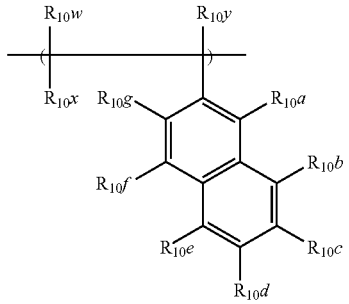

wherein $R_{10w}$ and $R_{10x}$ are each independently a halogen atom or a hydrogen atom; $R_{10y}$ is a $CH_3$ group or a hydrogen atom; $R_{10a}$, $R_{10b}$, $R_{10c}$, $R_{10d}$, $R_{10e}$, $R_{10f}$, and $R_{10g}$ are each independently $SO_3R_{10h}$ wherein $R_{10h}$ is a hydrogen atom, a linear or branched alkyl group having 1 to 8 carbon atoms, a substituted or unsubstituted aromatic ring structure, or a substituted or unsubstituted heterocyclic ring structure, a hydrogen atom, a linear or branched alkyl group having 1 to 8 carbon atoms, or a linear or branched alkoxyl group having 1 to 8 carbon atoms, and at least one of $R_{10a}$, $R_{10b}$, $R_{10c}$, $R_{10d}$, $R_{10e}$, $R_{10f}$, and $R_{10g}$ is independently $SO_3R_{10h}$.

A toner for developing electrostatic latent images of the present invention is a toner for developing electrostatic latent images comprising a binder resin, a colorant, and the charge control agent according to the first to third aspects of the present invention.

According to the present invention, there can be provided a novel polymer having a sulfonic group, a sulfonic acid ester group, or a derivative thereof, a method of producing the polymer, and a novel compound suitable for producing the polymer.

Further features of the present invention will become apparent from the following description of exemplary embodiments with reference to the attached drawing.

BRIEF DESCRIPTION OF THE DRAWINGS

The FIGURE is a schematic view showing a blow-off charge quantity measuring device for measuring the charge quantity of toner, where reference numeral 41 denotes a charge quantity measuring device, reference numeral 42 denotes a measuring container, reference numeral 43 denotes a screen, reference numeral 44 denotes a lid, reference numeral 45 denotes a vacuum gauge, reference numeral 46 denotes an airflow control valve, reference numeral 47 denotes a suction port, reference numeral 48 denotes a capacitor, and reference numeral 49 denotes an electrometer.

Although only some exemplary embodiments of this invention have been described in detail above, those skilled in the art will readily appreciate that many modifications are possible in the exemplary embodiments without materially departing from the novel teachings and advantages of this invention. Accordingly, all such modifications are intended to be included within the scope of this invention.

DESCRIPTION OF THE EMBODIMENTS

Polymer and Compound According to the Present Invention

<1> Each of polymers according to the first to third aspects of the present invention is characterized by containing one or more units each having a structure represented by any one of the chemical formulae (1) to (3) described above.

In the present invention, when multiple units are present in a polymer, the respective units are each independently represented in accordance with the definition of each formula. For example, multiple identical units each represented by the formula (1) may be present, or different units each represented by the formula (1) may be present. The foregoing holds true for the units each represented by any other formula. That is, the present invention includes not only the case where the polymer is constituted of the same kind of units but also the case where the polymer is constituted of units different from each other.

<4> A polymer according to the fourth aspect of the present invention is characterized by containing at least one unit derived from a vinyl monomer represented by a chemical formula (4) in addition to a unit represented by the chemical formula (1):

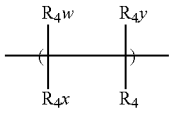

(4)

In the chemical formula (4), $R_{4w}$ and $R_{4x}$ are each independently a halogen atom or a hydrogen atom, $R_{4y}$ is a $CH_3$ group, a halogen atom, or a hydrogen atom, $R_4$ is a hydrogen atom, a substituted or unsubstituted aliphatic hydrocarbon structure, a substituted or unsubstituted aromatic ring structure, a substituted or unsubstituted heterocyclic ring structure, a halogen atom, —CO—$R_{4a}$, —O—$R_{4b}$, —COO—$R_{4c}$, —OCO—$R_{4d}$, —CONR$_{4e}$R$_{4f}$, —CN, or a ring structure containing an N atom, and $R_{4a}$, $R_{4b}$, $R_{4c}$, $R_{4d}$, $R_{4e}$, and $R_{4f}$ are each independently a hydrogen atom, a substituted or unsubstituted aliphatic hydrocarbon structure, a substituted or unsubstituted aromatic ring structure, or a substituted or unsubstituted heterocyclic ring structure.

<5> Each of polymers according to the fifth and sixth aspects of the present invention is characterized by containing at least one unit derived from a vinyl monomer represented by the chemical formula (4) in addition to a unit represented by the chemical formula (2) or (3).

<12> A compound as a monomer for introducing a unit represented by the chemical formula (1) into a polymer is characterized by having a structure represented by the chemical formula (5) described above.

Examples of the compound as represented by the chemical formula (5) include 4-ethenyl-2-methyl methoxybenzenesulfonate, 4-ethenyl-2-methyl methylbenzenesulfonate, and 4-isopentyl ethenylbenzenesulfonate (i.e., p-isopentyl styrenesulfonate). The examples further include 4-(2-ethylbutyl) ethenylbenzenesulfonate and 4-normal heptyl ethenylbenzenesulfonate.

An example of a method of producing the compound represented by the chemical formula (5) will be described below.

A method of producing normal heptyl 4-ethenylbenzenesulfonate will be described.

Normal heptyl 4-ethenylbenzenesulfonate can be produced with reference to Journal of Polymer Science, Polymer Chemistry Edition (1981), 19(8), 1995.

2-bromoethylbenzene and sulfonyl chloride can be allowed to react with each other to yield 4-(2-bromoethyl)-benzenesulfonyl chloride. Next, 4-(2-bromoethyl)-benzenesulfonyl chloride is esterified with normal heptyl alcohol, and is then subjected to dehydrobromination, whereby normal heptyl 4-ethenylbenzenesulfonate as a target can be obtained.

Therefore, various alkyl ethenylbenzenesulfonates can be obtained by employing a similar approach.

An alkyl ethenylbenzenesulfonate can be obtained as described below.

That is, 2-(2-bromoethyl)benzenesulfonic acid, 3-(2-bromoethyl)benzenesulfonic acid, and 4-(2-bromoethyl)benzenesulfonic acid each obtained by sulfonating (2-bromoethyl) benzene with fuming sulfuric acid are separated and purified.

Then, each isomer is subjected to dehydrobromination. After that, the sulfonic acids are each esterified with an esterifying agent, whereby various alkyl ethenylbenzenesulfonates can be obtained. It should be noted that a sulfonic acid can be esterified with reference to SYNTHETIC COMMUNICATIONS, 15(12), 21, 1057-1062 (1985).

<13> A monomer for introducing a unit represented by the chemical formula (2) into a polymer is characterized by having a structure represented by the chemical formula (6) described above.

Examples of the compound represented by the chemical formula (6) include methyl 4-ethenyl-1-naphthalenesulfonate, methyl 4-ethenyl-3-methoxy-1-naphthalenesulfonate, and methyl 4-ethenyl-3-methyl-1-naphthalenesulfonate.

An example of a method of producing the compound represented by the chemical formula (6) will be described below.

A method of producing methyl 4-ethenyl-1-naphthalenesulfonate will be described.

1-(2-bromoethyl)naphthalene and sulfonyl chloride can be allowed to react with each other to yield 4-(2-bromoethyl)-naphthalenesulfonyl chloride. Next, 4-(2-bromoethyl)-naphthalenesulfonyl chloride is esterified with methyl alcohol, and is then subjected to dehydrobromination, whereby methyl 4-ethenyl-1-naphthalenesulfonate as a target can be obtained.

Therefore, various alkyl ethenylnaphthalenesulfonates can be obtained by employing a similar approach.

An alkyl 4-ethenylnaphthalenesulfonate can be obtained as described below.

That is, 4-(2-bromoethyl)naphthalenesulfonic acid obtained by sulfonating 1-(2-bromoethyl)naphthalene with fuming sulfuric acid is subjected to dehydrobromination. After that, the sulfonic acid is esterified with an esterifying agent, whereby various alkyl 4-ethenylnaphthalenesulfonates can be obtained.

<14> A compound for introducing a unit represented by the chemical formula (3) into a polymer is characterized by having a structure represented by the chemical formula (7).

Examples of the compound represented by the chemical formula (7) include 2-ethenyl-1-naphthalenesulfonic acid, methyl 2-ethenyl-1-naphthalenesulfonate, methyl 2-ethenyl-4-methoxy-1-naphthalenesulfonate, and methyl 2-ethenyl-4-methyl-1-naphthalenesulfonate.

The compound represented by the chemical formula (7) can be produced by using 2-(2-bromoethyl)naphthalene as a starting material in the same manner as in the method of producing the compound represented by the chemical formula (6) described above.

(Production Method)

Hereinafter, the present invention will be described in more detail by way of preferred embodiments. The polymer according to the present invention having any one of the above-mentioned respective constitutions has extremely excellent charging property. Examples of a method of producing the polymer according to the present invention include the following methods.

The polymer according to the first aspect of the present invention, that is, the polymer containing a unit represented by the chemical formula (1) described above can be produced by polymerizing at least one kind of a compound represented by the chemical formula (5).

The polymer according to the second aspect of the present invention, that is, the polymer containing a unit represented by the chemical formula (2) described above can be produced by polymerizing at least one kind of a compound represented by the chemical formula (6).

The polymer according to the third aspect of the present invention, that is, the polymer containing a unit represented by the chemical formula (3) described above can be produced by polymerizing at least one kind of a compound represented by the chemical formula (7).

The polymer according to the fourth aspect of the present invention, that is, the polymer containing at least one unit derived from a vinyl monomer and represented by the chemical formula (4) in addition to a unit represented by the chemical formula (1) can be obtained as described below. That is, the polymer can be produced by copolymerizing at least one kind of a compound represented by the chemical formula (5) and at least one kind of a compound represented by a chemical formula (12).

The content ratio (mol %) between the unit represented by the chemical formula (1) and the unit represented by the chemical formula (4) is preferably 0.1:99.9 to 90:10, or more preferably 1.0 to 99.0 to 50:50.

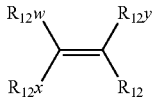

(12)

wherein $R_{12w}$ and $R_{12x}$ are each independently a halogen atom or a hydrogen atom, $R_{12y}$ is a $CH_3$ group, a halogen atom, or a hydrogen atom, $R_{12}$ is a hydrogen atom, a substituted or unsubstituted aliphatic hydrocarbon structure, a substituted or unsubstituted aromatic ring structure, a substituted or unsubstituted heterocyclic ring structure, a halogen atom, —CO—$R_{12a}$, —O—$R_{12b}$, —COO—$R_{12c}$, —OCO—$R_{12d}$, —CONR$_{12e}$R$_{12f}$, —CN, or a ring structure containing an N atom, and $R_{12a}$, $R_{12b}$, $R_{12c}$, $R_{12d}$, $R_{12e}$, and $R_{12f}$ are each independently a hydrogen atom, a substituted or unsubstituted aliphatic hydrocarbon structure, a substituted or unsubstituted aromatic ring structure, or a substituted or unsubstituted heterocyclic ring structure.

Further, the polymer according to the fifth aspect of the present invention, that is, the polymer containing at least one unit derived from a vinyl monomer and represented by the chemical formula (4) in addition to a unit represented by the chemical formula (2) can be obtained as described below. That is, the polymer can be produced by copolymerizing at least one kind of a compound represented by the chemical formula (6) and at least one kind of a compound represented by a chemical formula (12).

The content ratio (mol %) between the unit represented by the chemical formula (2) and the unit represented by the chemical formula (4) is preferably 0.1:99.9 to 90:10, or more preferably 1.0 to 99.0 to 50:50.

Further, the polymer according to the sixth aspect of the present invention, that is, the polymer containing at least one unit derived from a vinyl monomer and represented by the chemical formula (4) in addition to a unit represented by the chemical formula (3) can be obtained as described below. That is, the polymer can be produced by copolymerizing at least one kind of a compound represented by the chemical formula (7) and at least one kind of a compound represented by a chemical formula (12).

The content ratio (mol %) between the unit represented by the chemical formula (3) and the unit represented by the chemical formula (4) is preferably 0.1:99.9 to 90:10, or more preferably 1.0 to 99.0 to 50:50.

Examples of the compound represented by the chemical formula (12) include: styrene and a derivative of styrene; unsaturated monoolefins; vinyl halides; vinyl ester acids; α-methylene aliphatic monocarboxylates; acrylates; vinyl ethers; and vinyl ketones.

Radical polymerization or ionic polymerization can be employed as a method of polymerizing the polymer according to any one of the first to sixth aspects of the present invention.

When the radical polymerization is employed, examples of an initiator include t-butylperoxy-2-ethylhexanoate and other initiators. Each of those initiators can be used alone, or two or more of them can be used in combination. The usage of the initiator, which is preferably in the molar range of 0.0001 to 0.5 time as large as the total amount of a polymerizable monomer, can be appropriately set depending on the kind of a monomer to be used, a monomer to be used in copolymerization, and the initiator to be used.

Examples of a solvent applicable to a polymerization reaction of the present invention include: hydrocarbons such as hexane; ketones such as acetone; and ethers such as dimethyl ether and diethyl ether.

The examples further include: halogenated hydrocarbons such as dichloromethane and chloroform; aromatic hydrocarbons such as benzene and toluene; and aprotic polar solvents such as N,N-dimethylformamide and dimethyl sulfoxide. Of those, the aprotic polar solvents such as N,N-dimethylformamide and dimethyl sulfoxide are particularly preferably used.

When styrene sulfonic acid or ethenylnaphthalenesulfonic acid and the compound represented by the chemical formula (12) are copolymerized, an esterifying agent such as trimethylsilyldiazomethane, trimethyl orthoformate, or triethyl orthoformate can be used for esterifying the sulfonic acid.

In the reaction, any one of the above-mentioned solvents and the like can be used as needed, with chloroform or methanol being preferably used. The usage of the solvent can be appropriately set depending on, for example, a starting material and a reaction condition.

The usage of the esterifying agent is in the range of 0.1 to 50 times, or preferably 1 to 20 times as large as the number of moles of a sulfonic acid unit.

In the method, a reaction temperature, which is not particularly limited, is typically in the range of −20° C. to 30° C., and a reaction time, which cannot be uniquely determined, is typically in the range of 1 to 48 hours.

A polymer according to the present invention having a molecular weight distribution (weight average molecular weight/number average molecular weight=Mw/Mn) satisfying the relationship of $1<Mw/Mn<2$ can be produced by subjecting a compound represented by the chemical formula (5), the chemical formula (6), or the chemical formula (7) to living polymerization.

In addition, a copolymer having a molecular weight distribution (weight average molecular weight/number average molecular weight=Mw/Mn) satisfying the relationship of $1.00<Mw/Mn<2.00$ can be obtained as described below.

That is, the copolymer can be produced by copolymerizing a compound represented by the chemical formula (5), the chemical formula (6), or the chemical formula (7) and a compound represented by the chemical formula (12) by living polymerization.

Living radical polymerization, living anion polymerization, living cation polymerization, or the like can be employed as the living polymerization. For example, atom transfer radical polymerization or nitroxide-mediated polymerization can be employed as the living radical polymerization.

Next, the case where the living radical polymerization is the nitroxide-mediated polymerization will be described.

2,2,6,6-tetramethylpyridine (TEMPO) as one of the nitroxyl radicals is hardly bonded to a radical that applies low dissociation energy as a result of bonding because unpaired electrons are delocalized in 2,2,6,6-tetramethylpyridine. A polymer having a narrow molecular weight distribution or a polymer having a controlled structure such as a block copolymer can be obtained by nitroxide-mediated polymerization using a nitroxyl radical with the aid of the foregoing nature. It should be noted that benzoyl peroxide (BPO) or azobisisobutyronitrile (AIBN) is used as an initiator.

The polymerizable monomer, the initiator, and the nitroxyl radical are added to a reaction solvent, and a reaction system is replaced with an inert gas before nitroxide-mediated polymerization is performed.

Examples of a nitroxyl radical that can be used include the following radicals.

Nitroxyl Radical 1 (TEMPO)

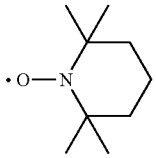

Nitroxyl Radical 2

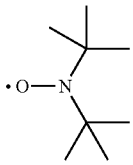

Nitroxyl Radical 3

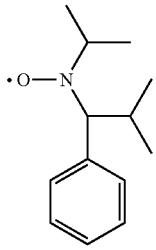

Nitroxyl Radical 4

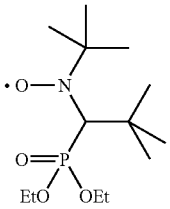

-continued

Nitroxyl Radical 5

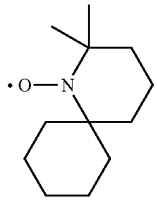

Nitroxyl Radical 6

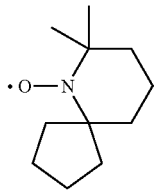

Nitroxyl Radical 7

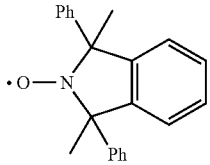

Nitroxyl Radical 8

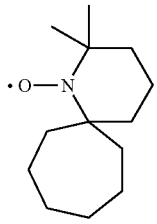

Examples of a reaction solvent that can be used include dimethyl sulfoxide, dimethylformamide, benzene, toluene, xylene, ethyl benzene, and diphenyl ether. Each of them may be used alone, or two or more of them may be used in combination. Alternatively, polymerization may be performed without the use of any reaction solvent.

(Charge Control Agent)

<1> A first charge control agent according to the present invention controls the charging state of fine particles, and is characterized by being composed of a polymer containing one or more units each having a structure represented by any one of the chemical formulae (8) to (10) described above.

<4> The charge control agent according to the present invention controls the charging state of fine particles, and may be composed of a copolymer containing at least one unit derived from a vinyl monomer and represented by a chemical formula (11) in addition to a unit represented by the chemical formula (8) described above:

(11)

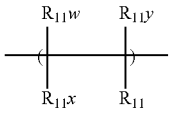

wherein $R_{11w}$ and $R_{11x}$ are each independently a halogen atom or a hydrogen atom, $R_{11y}$ is a $CH_3$ group, a halogen atom, or a hydrogen atom, $R_{11}$ is a hydrogen atom, a substituted or unsubstituted aliphatic hydrocarbon structure, a substituted or unsubstituted aromatic ring structure, a substituted or unsubstituted heterocyclic ring structure, a halogen atom, —CO—$R_{11a}$, —O—$R_{11b}$, —COO—$R_{11c}$, —OCO—$R_{11d}$, —CONR$_{11e}$R$_{11f}$, —CN, or a ring structure containing an N atom, and $R_{11a}$, $R_{11b}$, $R_{11c}$, $R_{11d}$, $R_{11e}$, and $R_{11f}$ are each independently a hydrogen atom, a substituted or unsubstituted aliphatic hydrocarbon structure, a substituted or unsubstituted aromatic ring structure, or a substituted or unsubstituted heterocyclic ring structure.

<5> The charge control agent according to the present invention controls the charging state of fine particles, and may be a copolymer containing at least one unit derived from a vinyl monomer and represented by the chemical formula (11) in addition to a unit represented by the chemical formula (9) or (10) described above.

<7> A polymer constituting the charge control agent according to the present invention controls the charging state of fine particles, and preferably has a number average molecular weight of 1,000 to 1,000,000.

<8> The polymer constituting the charge control agent according to the present invention controls the charging state fine particles, and can have a molecular weight distribution (weight average molecular weight/number average molecular weight=Mw/Mn) satisfying the relationship of 1.00<Mw/Mn<2.00. <9> A copolymer constituting the charge control agent according to the present invention can be a block copolymer.

It is preferable that fine particles are a toner for developing electrostatic latent images.

(Method of Producing Charge Control Agent According to the Present Invention)

The charge control agent according to the present invention, that is, the charge control agent composed of a polymer containing a unit represented by the chemical formula (8) described above can be produced by polymerizing at least one kind of a compound represented by a chemical formula (13):

(13)

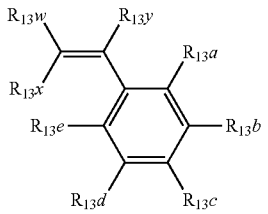

wherein $R_{13w}$ and $R_{13x}$ are each independently a halogen atom or a hydrogen atom, $R_{13y}$, is a $CH_3$ group or a hydrogen atom, $R_{13a}$, $R_{13b}$, $R_{13c}$, $R_{13d}$, and $R_{13e}$ are each independently $SO_3R_{13f}$ (wherein $R_{13f}$ is a linear or branched alkyl group having 1 to 8 carbon atoms, or a substituted or unsubstituted phenyl group), a hydrogen atom, a linear or branched alkyl group having 1 to 8 carbon atoms, or a linear or branched alkoxyl group having 1 to 8 carbon atoms, and at least one of $R_{13a}$, $R_{13b}$, $R_{13c}$, $R_{13d}$, and $R_{13e}$ is $SO_3R_{13f}$.

Examples of the compound represented by the chemical formula (13) include the following compounds in addition to the specific examples of the compound represented by the chemical formula (5) described above: methyl 4-ethenylbenzenesulfonate (methyl p-styrenesulfonate) and ethyl 4-ethenylbenzenesulfonate.

The charge control agent according to the present invention, that is, the charge control agent composed of a polymer containing a unit represented by the chemical formula (9) described above can be produced by polymerizing at least one kind of a compound represented by a chemical formula (14):

(14)

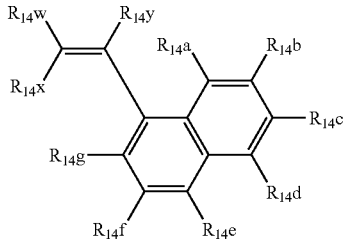

wherein $R_{14w}$ and $R_{14x}$ are each independently a halogen atom or a hydrogen atom, $R_{14y}$ is a $CH_3$ group or a hydrogen atom, $R_{14a}$, $R_{14b}$, $R_{14c}$, $R_{14d}$, $R_{14e}$, $R_{14f}$, and $R_{14g}$ are each independently $SO_3R_{14h}$ (wherein $R_{14h}$ is a linear or branched alkyl group having 1 to 8 carbon atoms, or a substituted or unsubstituted phenyl group), a hydrogen atom, a linear or branched alkyl group having 1 to 8 carbon atoms, or a linear or branched alkoxyl group having 1 to 8 carbon atoms, and at least one of $R_{14a}$, $R_{14b}$, $R_{14c}$, $R_{14d}$, $R_{14e}$, $R_{14f}$, and $R_{14g}$ is $SO_3R_{14h}$.

Examples of the compound represented by the chemical formula (14) include 4-ethenyl-1-naphthalenesulfonic acid in addition to the specific examples of the compound represented by the chemical formula (6) described above.

The charge control agent according to the present invention, that is, the charge control agent composed of a polymer containing a unit represented by the chemical formula (10) described above can be produced by polymerizing at least one kind of a compound represented by a chemical formula (15):

(15)

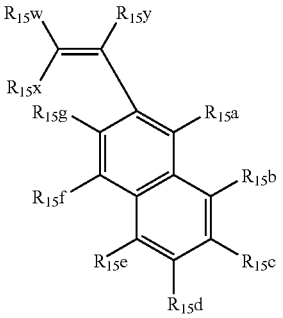

wherein $R_{15w}$ and $R_{15x}$ are each independently a halogen atom or a hydrogen atom, $R_{15y}$, is a $CH_3$ group or a hydrogen atom, $R_{15a}$, $R_{15b}$, $R_{15c}$, $R_{15d}$, $R_{15e}$, $R_{15f}$, and $R_{15g}$ are each independently $SO_3R_{15h}$ (wherein $R_{15h}$ is a linear or branched alkyl group having 1 to 8 carbon atoms, or a substituted or unsubstituted phenyl group), a hydrogen atom, a linear or branched alkyl group having 1 to 8 carbon atoms, or a linear or branched alkoxyl group having 1 to 8 carbon atoms, and at least one of $R_{15a}$, $R_{15b}$, $R_{15c}$, $R_{15d}$, $R_{15e}$, $R_{15f}$, and $R_{15g}$ is $SO_3R_{15h}$.

Examples of the compound represented by the chemical formula (15) include the specific examples of the compound represented by the chemical formula (7) described above.

The charge control agent according to the present invention, that is, the charge control agent composed of a polymer containing at least one unit derived from a vinyl monomer and represented by the chemical formula (11) in addition to a unit represented by the chemical formula (8) can be obtained as described below. That is, the charge control agent can be produced by copolymerizing at least one kind of a compound represented by the chemical formula (13) and at least one kind of a compound represented by the chemical formula (12).

The content ratio (mol %) between the unit represented by the chemical formula (8) and the unit represented by the chemical formula (11) is preferably 0.1:99.9 to 90:10, or more preferably 1.0 to 99.0 to 49:51. In addition, the charge control agent according to the present invention, that is, the charge control agent composed of a polymer containing at least one unit derived from a vinyl monomer and represented by the chemical formula (11) in addition to a unit represented by the chemical formula (9) can be obtained as described below. That is, the charge control agent can be produced by copolymerizing at least one kind of a compound represented by the chemical formula (14) and at least one kind of a compound represented by the chemical formula (12).

The content ratio (mol %) between the unit represented by the chemical formula (9) and the unit represented by the chemical formula (11) is preferably 0.1:99.9 to 90:10, or more preferably 1.0 to 99.0 to 49:51.

The charge control agent according to the present invention, that is, the charge control agent composed of a polymer containing at least one unit derived from a vinyl monomer and represented by the chemical formula (11) in addition to a unit represented by the chemical formula (10) can be obtained as described below. That is, the charge control agent can be produced by copolymerizing at least one kind of a compound represented by the chemical formula (15) and at least one kind of a compound represented by the chemical formula (12).

The content ratio (mol %) between the unit represented by the chemical formula (10) and the unit represented by the chemical formula (11) is preferably 0.1:99.9 to 90:10, or more preferably 1.0 to 99.0 to 49:51.

The radical polymerization or the ionic polymerization described above can be employed as a method of polymerizing the charge control agent according to the present invention.

When the radical polymerization is employed, an initiator and a solvent similar to those described above can be used.

A charge control agent according to the present invention having a molecular weight distribution (weight average molecular weight/number average molecular weight=Mw/Mn) satisfying the relationship of $1.00<Mw/Mn<2.00$ can be produced by subjecting, for example, a compound represented by the chemical formula (13), the chemical formula (14), or the chemical formula (15) to living polymerization.

In addition, a copolymer having a molecular weight distribution (weight average molecular weight/number average molecular weight=Mw/Mn) satisfying the relationship of $1.00<Mw/Mn<2.00$ can be obtained as described below. That is, the copolymer can be produced by copolymerizing a compound represented by the chemical formula (13), the chemical formula (14), or the chemical formula (15) and a compound represented by the chemical formula (12) by living polymerization.

A charge control agent according to the present invention, that is, a charge control agent which is a block copolymer can be obtained as described below. That is, the charge control agent can be produced by: producing a homopolymer from a compound represented by the chemical formula (13), the chemical formula (14), or the chemical formula (15) by living polymerization; and subjecting a terminal of the homopolymer to block copolymerization with a compound represented by the chemical formula (12) by living polymerization. It should be noted that the block copolymer may be formed by: producing a homopolymer from the compound represented by the chemical formula (12) by living polymerization; and subjecting a terminal of the homopolymer to block copolymerization with the compound represented by the chemical formula (13), the chemical formula (14), or the chemical formula (15) by living polymerization.

<Use as Charge Control Agent>

The charge control agent according to the present invention has a structure containing a sulfonic acid ester group or a derivative thereof at a side chain like the unit represented by the chemical formulae (8) to (10). The presence of a unit having an anionic or electron attractive functional group exhibits excellent negative charging property. The charge control agent according to the present invention has good compatibility with a binder resin of toner. In particular, the polymer has extremely good compatibility with a polyester binder resin.

Toner containing the charge control agent of the present invention has a high specific charge quantity and good stability over time. Therefore, a distinct image can be stably obtained in image formation in electrostatic recording even if the toner is stored for a long period of time. In addition, the charge control agent according to the present invention may be colorless or may have extremely weak tint, and has good negative charging property. Therefore, the charge control agent according to the present invention can be preferably used for both black negatively charged toner and color toner. Further, compatibility can be widely controlled by appropriately selecting the kinds/composition ratios of monomer units constituting the polymer of the present invention.

Here, when a resin composition is selected in such a manner that a charge control agent has a microphase separated structure in a toner binder, charge can be stably maintained because no electrical continuity of toner occurs.

When the charge control agent according to the present invention is used, the charge control agent can be used in combination with any known charge control agent described above.

(Application to Toner)

Applications of the charge control agent according to the present invention include applications to toner for developing electrostatic latent images and an image forming process using the same.

To be specific, the polymer can be used as a charge control agent to be internally or externally added to toner. That is, the present invention relates to a charge control agent containing the polymer described above and a toner for developing electrostatic latent images containing the charge control agent.

The use of, for example, a copolymer of a unit having a structure represented by the chemical formula (8) and a unit having a structure represented by the chemical formula (11) as a charge control agent for use in toner composition can provide the following effect: excellent charging characteristics can be obtained, and the dispersibility of the compound in a toner resin and the spent property of the compound become good. In addition, the use of the charge control agent according to the present invention can provide a toner for developing electrostatic latent images which reduces generation of image fog and excellent transfer property even in output by an image forming device.

Further, because the charge control agent according to the present invention can be made colorless, or its degree of coloration can be reduced, an arbitrary colorant can be selected in accordance with a hue demanded for color toner without being influenced by the charge control agent. A colorless, or thinly colored charge control agent is preferable because it hardly impairs a hue inherent to a dye or pigment.

(Addition of the Charge Control Agent According to the Present Invention to Toner)

In the present invention, a method involving internal addition to toner or a method involving external addition to toner may be used as a method of incorporating a charge control agent composed of any one of the polymers described above into toner. The addition amount of a charge control agent in the case of internal addition is generally within the range of 0.1 to 50 mass %, or preferably 0.2 to 20 mass % with respect to the total mass of a toner binder and the charge control agent. An addition amount of less than 0.1 mass % may result in a case where the degree of improvement in charging property of toner is not remarkable. On the other hand, an addition amount in excess of 50 mass % is not preferable from the viewpoint of economy in some cases. The mass ratio between a toner binder and a charge control agent in the case of external addition is preferably within the range of 0.01 to 5 mass % with respect to the total mass of the toner binder and the charge control agent. It is particularly preferable to allow the charge control agent to mechanochemically adhere to the toner surface.

The charge control agent according to the present invention has a number average molecular weight of generally 1,000 to 1,000,000, or preferably 1,000 to 300,000. A number average molecular weight of less than 1,000 provides an insufficient charge quantity and adversely affects the fluidity of toner in some cases because the polymer is completely compatible with a toner binder and a discontinuous domain is hardly formed. In addition, a number average molecular weight in excess of 1,000,000 makes it difficult to disperse the polymer into toner in some cases.

The molecular weight of the charge control agent of the present invention was measured by means of gel permeation chromatography (GPC). A specific measurement method by means of GPC involved: dissolving the above-mentioned polymer into a 0.1 mass % LiBr-containing dimethylformamide (DMF), chloroform, or the like in advance; measuring many samples in the same mobile phase; and determining a molecular weight distribution from a calibration curve of a standard polystyrene resin.

In addition, the molecular weight distribution (weight average molecular weight/number average molecular weight=Mw/Mn) of the charge control agent of the present invention satisfies the relationship of $1.00<Mw/Mn<2.00$, preferably $1<Mw/Mn\leqq1.50$, or more preferably $1<Mw/Mn\leqq1.30$.

The composition of the toner for developing electrostatic latent images of the present invention is generally 0.1 to 50 mass % of a charge control agent, 20 to 95 mass % of a toner binder, and 0 to 15 mass % of a coloring material based on the toner mass. The toner may contain 60 mass % or less of magnetic powder (iron, a compound such as ferrite, or the like) serving also as a coloring material as required.

For the purpose of reducing the particle size of a discontinuous domain formed by the charge control agent of the present invention, a polymer that is compatible with the charge control agent of the present invention and is also compatible with a toner binder may also be incorporated as a compatibilizer.

An example of the compatibilizer includes a polymer in which a polymer chain containing 50 mol % or more of a monomer having substantially the same structure as that of a constituent monomer of the charge control agent of the present invention and a polymer chain containing 50 mol % or more of a monomer having substantially the same structure as that of a constituent monomer of the toner binder are bonded together.

A polymer in which those two polymer chains are bonded together in a graft manner or block manner is preferable.

The usage amount of the compatibilizer is generally 30 mass % or less, or preferably 1 to 10 mass % with respect to the charge control agent of the present invention.

<Other Components>

Hereinafter, other components constituting the toner for developing electrostatic latent images of the present invention will be described. The toner for developing electrostatic latent images according to the present invention may contain a binder resin, a colorant, and other additives to be added as required as well as the above-mentioned charge control agent.

(Binder Resin)

First, a general thermoplastic resin can be used as the binder resin for toner. Examples of an available thermoplastic resin include polystyrene and polyacrylate.

In addition, the charge control agent of the present invention can be mixed with a binder resin before being turned into toner, and the mixture can be used as a composition for producing toner having a charge controllability. Examples of the binder resin include a styrene polymer and a polyester polymer. Each of them may be used alone, or two or more of them may be used in combination.

Examples of the styrene polymer include: a copolymer of styrene and (meth)acrylate; and copolymers of other monomers copolymerizable with them.

Specific examples of the binder resin used in combination with the charge control agent of the present invention include styrene polymers such as a styrene-acrylic acid copolymer and a styrene-methacrylic acid-based copolymer. Specific examples of a polymerizable monomer include: styrene and derivatives thereof; ethylene unsaturated monoolefins; methacrylates; acrylates; vinyl ethers; and vinyl ketones.

When forming a binder resin to be used in combination with the charge control agent of the present invention, any one of such cross-linking agents as described below may be used as required.

In addition, when forming a binder resin to be used in combination with the charge control agent of the present invention, any one of such polymerization initiators as described below may be used as required. Examples of the polymerization initiator include t-butylperoxy-2-ethylhexanoate. Any one of the polymerization initiators may be used alone, or two or more of them may be used in combination. The polymerization initiator is used at a concentration of 0.05 part by mass, or preferably 0.1 to 15 parts by mass with respect to 100 parts by mass of a monomer.

The ratio of the charge control agent of the present invention to be internally added to a binder resin is generally 0.1 to 50 mass %, or preferably 0.2 to 20 mass %. When the mass ratio of the charge control agent to be internally added is less than 0.1 mass %, a charge quantity is low. When the mass ratio exceeds 50 mass %, charging stability of toner is degraded.

A conventionally used charge control agent other than the charge control agent of the present invention may be used in combination with the charge control agent of the present invention.

Any one of the colorants that are generally used for producing toner can be used as a colorant constituting the toner for developing electrostatic latent images of the present invention without particular limitation.

Also, when the toner for developing electrostatic latent images of the present invention is used as two-component full-color toner, examples of a colorant to be used include C.I. Pigment Red 1 and 2.

In the present invention, each of the above-mentioned pigments may be used alone, but it is preferable to use a dye and a pigment in combination to improve the visibility in terms of image quality of a full-color image.

The content of any one of such colorants as described above in toner may be widely changed in accordance with a desired coloring effect and the like. For obtaining the best toner characteristics, that is, in consideration of the coloring power of a printed letter, shape stability of toner, scattering of toner, and the like, any one of those colorants is used in an amount of generally about 0.1 to 60 parts by mass, or preferably about 0.5 to 20 parts by mass with respect to 100 parts by mass of a binder resin.

The toner for developing electrostatic latent images of the present invention may contain any one of the following compounds as well as the binder resin and colorant components described above to such an extent that an effect of the present invention is not adversely affected.

<Method of Producing Toner>

Any one of the conventionally known methods can be used as a specific method of producing the toner for developing electrostatic latent images of the present invention having such a constitution as described above.

(Silica External Additive)

In the present invention, silica fine powder is preferably externally added to toner produced by means of such a method as described above for improving charging stability, developability, fluidity, and durability.

(Inorganic Powder)

Any one of the inorganic powders described below is also preferably added for improving the developability and durability of the toner. Examples of the inorganic fine powders include oxides of metals such as magnesium. Fine powder of zinc oxide, aluminum oxide, cobalt oxide, manganese dioxide, strontium titanate, or magnesium titanate is preferably used.

Any one of the lubricant powders described below may be further added to the toner. Examples of the lubricant powders include Teflon.

<With Regard to Carrier>

The toner for developing electrostatic latent images of the present invention can be singly used as a nonmagnetic one-component developer, or can be applied to any one of the conventionally known various toners such as a nonmagnetic toner constituting a magnetic two-component developer together with a magnetic carrier and a magnetic toner to be singly used as a magnetic one-component toner.

<Magnetic Toner>

The toner for developing electrostatic latent images of the present invention may contain a magnetic material in its toner particles to serve as magnetic toner.

In the present invention, the average particle size and particle size distribution of the toner were measured by using an apparatus such as a Coulter Counter TA-II or a Coulter Multisizer (each manufactured by Beckman Coulter) connected with an interface (manufactured by Nikkaki-Bios) and a personal computer for outputting a number distribution and a volume distribution. A 1% aqueous solution of NaCl is prepared as an electrolyte to be used at this time by using extra-pure sodium chloride. For example, a commercially available ISOTON R-II (manufactured by Coulter Scientific Japan Ltd.) can also be used as an electrolyte. A specific measurement method is as described below. 100 to 150 ml of the electrolyte is added with 0.1 to 5 ml of a surfactant (preferably an alkylbenzene sulfonate) as a dispersant. Further, 2 to 20 mg of a sample to be measured is added to prepare a sample for measurement. The measurement is performed as described as follows. The electrolyte into which the sample to be measured was suspended was subjected to dispersion treatment for about 1 to 3 min by using an ultrasonic dispersing unit, and the volume and number of toner having a particle size of 2 μm or more were measured by means of a 100-μm aperture as an aperture using the Coulter counter TA-II to calculate a volume distribution and a number distribution. Subsequently, a weight average particle size (D4) on a volume basis and a length average particle size (D1) on a number basis were determined from the volume distribution according to the present invention and the number distribution according to the present invention, respectively.

<Charge Quantity>

A method of measuring a charge quantity according to a two-component method used in the present invention will be described below. A charge quantity measuring device shown in the FIGURE was used for the measurement. First, an EFV 200/300 (manufactured by Powder Tech) is used as a carrier, and a mixture prepared by adding 0.5 g of toner to be measured to 9.5 g of the carrier is placed in a polyethylene bottle having a volume of 50 to 100 ml. The bottle is set in a shaker with a constant amplitude, and is shaken for a predetermined period of time under shaking conditions of: an amplitude of 100 mm; and a shaking speed of 100 reciprocations/min. Next, 1.0 to 1.2 g of the mixture are placed in a metallic measurement container 42, which has a 500-mesh screen 43 at its bottom, of a charge quantity measuring device 41 shown in the FIGURE, and the container is capped with a metallic cap 44. The mass of the entire measurement container 42 at this time is measured and designated by W1 (g). Next, the toner in the container is sucked through a suction port 47 by means of a sucker (not shown) (at least part of the sucker in contact with the measurement container 42 is made of an insulator), and an airflow controlling valve 46 is adjusted in such a manner that a vacuum gage 45 indicates a pressure of 2,450 Pa (250 mmAq). Suction is performed for 1 min in this state to suck and remove the toner. The potential of an electrometer 49 at this time is defined as V (volt). Here, reference numeral 48 denotes a capacitor having a capacity defined as C (μF). In addition, the mass of the entire measuring device after the suction is measured and defined as W2 (g). The frictional charge quantity of the toner is calculated from those measured values according to the following calculation equation.

$$\text{Calculation formula:Frictional charge quantity}(\mu C/g) = C \times V/(W1 - W2)$$

Those processes are performed under constant environment (e.g., under constant temperature and humidity).

<Method of Measuring Molecular Weight and Molecular Weight Distribution of the Binder Resin>

In addition, a binder resin to be used as a constituent of the toner for developing electrostatic latent images of the present invention preferably has a peak in a low-molecular-weight region in the range of 3,000 to 15,000 in a molecular weight distribution by means of GPC particularly when produced by means of the pulverization method. That is, when a GPC peak in a low-molecular-weight region exceeds 15,000, an improvement in transfer efficiency may be hardly sufficient. It is not preferable to use a binder resin having a GPC peak in a low-molecular-weight region of less than 3,000 because fusion is apt to occur at the time of surface treatment.

In the present invention, the molecular weight of the binder resin was measured by means of gel permeation chromatography (GPC). For a specific measurement method according to GPC, a sample obtained by extracting toner with a tetrahydrofuran (THF) solvent for 20 hours by using a Soxhlet extractor is used. A column had a constitution in which A-801, 802, 803, 804, 805, 806, and 807 manufactured by Showa Denko K. K. were connected, and a molecular weight distribution was measured using a calibration curve of a standard polystyrene resin. In addition, in the present invention, a binder resin having a ratio (Mw/Mn) between a weight average molecular weight (Mw) and a number average molecular weight (Mn) measured as described above in the range of 2 to 100 is preferably used.

Incidentally, the present invention does not exclude a case where the polymer or the copolymer according to the present invention, which are described above, includes the sulfonated styrene or AMPS which are described in the Description of Related Art.

EXAMPLES

First, a novel polymer provided by the present invention will be described by way of Examples A to X. Next, usefulness of the present invention will be described by way of Examples 1 to 34 while using comparative examples.

The novel charge control agent, and the methods of producing thereof according to the present invention are not limited to the following examples.

In each of the following experiments, the structure of the charge control agent was determined in the following method. That is, analysis according to $^1$H-NMR (FT-NMR: Bruker Avance 500; resonance frequency: 500 MHz; measured nuclear species: $^1$H; solvent used: heavy DME, heavy DMSO, heavy chloroform, heavy THF, and heavy acetone; measurement temperature: room temperature), is performed.

The average molecular weight of the resultant polymer was evaluated by means of gel permeation chromatography (GPC; Tosoh Corporation, column; Polymer Laboratories PLgel 5μ MIXED-C, solvent; DMF/LiBr 0.1% (w/v), in terms of polystyrene).

Example A

Styrene (108 g), methyl p-styrenesulfonate (10.8 g), and 2,2'-azobisisobutyronitrile (1.2 g) were dissolved in DMF (120 g), and the whole was polymerized under a nitrogen atmosphere at 70° C. for 5 hours. As a result, a copolymer (90 g) containing units represented by the following formula (A) at a content ratio (mol %) (M0):(F0) of 95:5 was obtained. Incidentally, the content ratio between the respective units of the polymer was identified by $^1$H-NMR measurement. The copolymer had a number average molecular weight Mn of 17,000 and a molecular weight distribution (Mw/Mn) of 2.54. $^1$H-NMR data is shown below. $^1$H-NMR (500 MHz, heavy DMF) δ/ppm 7.45 to 7.75 (peak of a benzene ring), 6.40 to 7.40 (peak of a benzene ring), 3.65 to 3.80 (peak of $CH_3$ of methyl sulfonate), 1.20 to 2.50 (peak of a main chain).

(A)

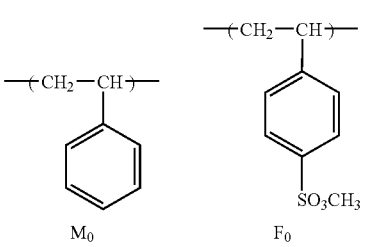

Example B

Copolymerization was performed by the same operation as that of Example A with the exception that ethyl p-styrenesulfonate was used instead of methyl p-styrenesulfonate of Example A. As a result, a copolymer (100 g) containing units represented by the following formula (B) at a content ratio (mol %) (M1):(F1) of 95:5 was obtained. The copolymer had a number average molecular weight Mn of 22,000 and a molecular weight distribution (Mw/Mn) of 2.62. $^1$H-NMR data is shown below. $^1$H-NMR (500 MHz, heavy DMF) δ/ppm 7.45 to 7.80 (peak of a benzene ring), 6.40 to 7.40 (peak of a benzene ring), 3.95 to 4.20 (peak of $CH_2$ of ethyl sulfonate), 1.15 to 2.50 (peak of a main chain), 1.15 to 1.30 (peak of $CH_3$ of ethyl sulfonate).

(B)

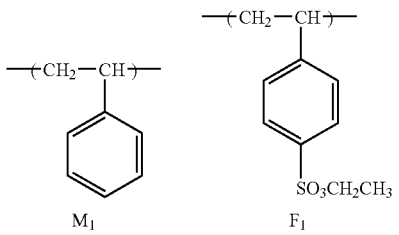

Example C

Methyl methacrylate (100 g), methyl m-styrenesulfonate (34.9 g), and 2,2'-azobisisobutyronitrile (1.4 g) were dissolved in DMF (135 g), and the whole was polymerized under a nitrogen atmosphere at 70° C. for 5 hours. As a result, a copolymer (113 g) containing units represented by the following formula (C) at a content ratio (mol %) (M2):(F2) of 85:15 was obtained. Incidentally, the content ratio between the respective units of the polymer was identified by $^1$H-NMR measurement. The copolymer had a number average molecular weight Mn of 16,000 and a molecular weight distribution (Mw/Mn) of 2.66.

(C)

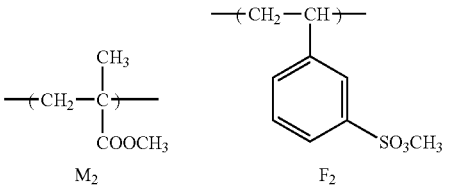

Example D

Copolymerization was performed by the same operation as that of Example C with the exception that ethyl m-styrenesulfonate was used instead of methyl m-styrenesulfonate of Example C. As a result, a copolymer (113 g) containing units represented by the following formula (D) at a content ratio (mol %) (M3):(F3) of 85:15 was obtained. Incidentally, the content ratio between the respective units of the polymer was identified by $^1$H-NMR measurement. The copolymer had a number average molecular weight Mn of 19,000 and a molecular weight distribution (Mw/Mn) of 2.61.

(D)

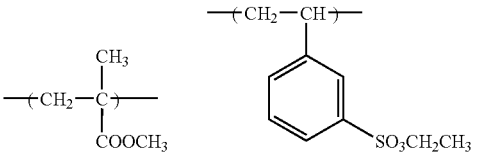

M3 F3

Example E

Styrene (108 g), methyl o-styrenesulfonate (10.8 g), and 2,2'-azobisisobutyronitrile (1.2 g) were dissolved in DMF (120 g), and the whole was polymerized under a nitrogen atmosphere at 70° C. for 5 hours. As a result, a copolymer (93 g) containing units represented by the following formula (E) at a content ratio (mol %) (M4):(F4) of 90:10 was obtained. Incidentally, the content ratio between the respective units of the polymer was identified by $^1$H-NMR measurement. The copolymer had a number average molecular weight Mn of 12,000 and a molecular weight distribution (Mw/Mn) of 2.59.

(E)

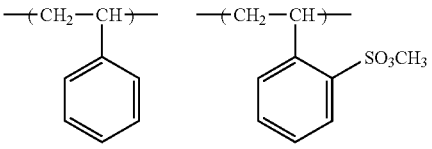

M4 F4

Example F

Copolymerization was performed by the same operation as that of Example E with the exception that ethyl o-styrenesulfonate was used instead of methyl o-styrenesulfonate of Example E. As a result, a copolymer (100 g) containing units represented by the following formula (E) at a content ratio (mol %) (M5):(F5) of 90:10 was obtained. Incidentally, the content ratio between the respective units of the polymer was identified by $^1$H-NMR measurement. The copolymer had a number average molecular weight Mn of 13,000 and a molecular weight distribution (Mw/Mn) of 2.53.

(F)

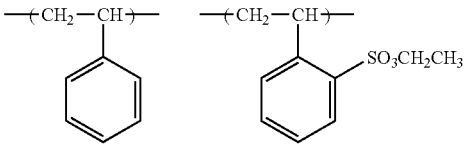

M5 F5

Example G

Styrene (110 g), methyl 4-ethenyl-1-methyl naphthalenesulfonate (20 g), and 2,2'-azobisisobutyronitrile (1.3 g) were dissolved in DMF (130 g), and the whole was polymerized under a nitrogen atmosphere at 70° C. for 5 hours. As a result, a copolymer (92 g) containing units represented by the following formula (G) at a content ratio (mol %) (M6):(F6) of 93:7 was obtained. The copolymer had a number average molecular weight Mn of 19,000 and a molecular weight distribution (Mw/Mn) of 2.61.

(G)

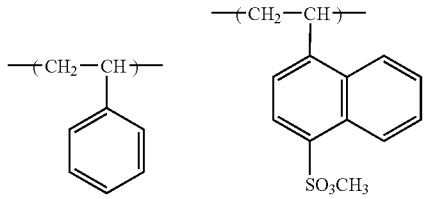

M6 F6

Example H

Ethyl methacrylate (115 g), 4-ethenyl-1-ethyl naphthalenesulfonate (30 g), and 2,2'-azobisisobutyronitrile (1.4 g) were dissolved in DMF (145 g), and the whole was polymerized under a nitrogen atmosphere at 70° C. for 5 hours. As a result, a copolymer (101 g) containing units represented by the following formula (H) at a content ratio (mol %) (M7):(F7) of 90:10 was obtained. The copolymer had a number average molecular weight Mn of 25,000 and a molecular weight distribution (Mw/Mn) of 2.64.

(H)

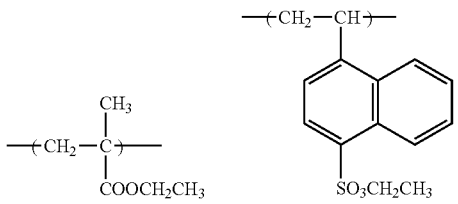

M7 F7

Example I

A copolymer represented by the following formula (I) was synthesized by employing atom transfer radical polymerization (ATRP).

Styrene (104 g), methyl p-styrenesulfonate (17 g), 1-bromoethylbenzene (0.9 g) as an initiation seed, and copper bromide (1.3 g) as a catalyst were dissolved in DMF. Further, 1,1,4,7,10,10-hexamethyltriethylenetetramine (2.1 g) as a ligand was also dissolved in the DMF (115 g), and the whole was polymerized under a nitrogen atmosphere at 70° C. for 7 hours. As a result, a copolymer (91 g) containing units represented by the following formula (1) at a content ratio (mol %) (M8):(F8) of 92:8 was obtained. The copolymer had a number average molecular weight Mn of 20,000 and a molecular weight distribution (Mw/Mn) of 1.24.

(I)

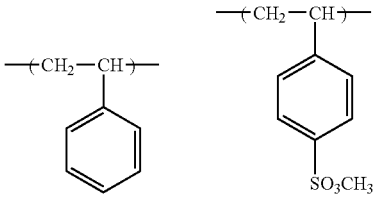

M8 F8

Example J

A copolymer represented by the following formula (J) was synthesized by employing atom transfer radical polymerization. Copolymerization was performed by following the same procedure as that of Example I with the exception that methyl m-styrenesulfonate was used instead of methyl p-styrenesulfonate of Example I. As a result, a copolymer (92 g) containing units represented by the following formula (J) at a content ratio (mol %) (M9):(F9) of 92:8 was obtained. The copolymer had a number average molecular weight Mn of 19,000 and a molecular weight distribution (Mw/Mn) of 1.22.

(J)

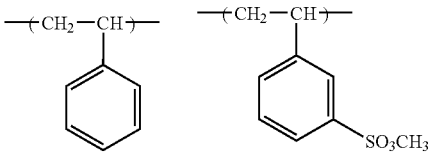

M9 F9

Example K

A copolymer represented by the following formula (K) was synthesized by employing atom transfer radical polymerization. Copolymerization was performed by following the same procedure as that of Example I with the exception that methyl o-styrenesulfonate was used instead of methyl p-styrenesulfonate of Example I. As a result, a copolymer (93 g) containing units represented by the following formula (K) at a content ratio (mol %) (M10):(F10) of 92:8 was obtained. The copolymer had a number average molecular weight Mn of 21,000 and a molecular weight distribution (Mw/Mn) of 1.21.

(K)

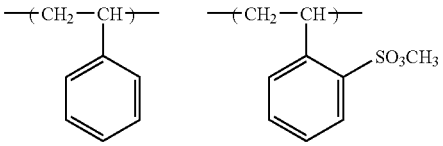

M10 F10

Example L

A copolymer represented by the following formula (L) was synthesized by employing nitroxide-mediated polymerization.

The following materials were dissolved in DMF (130 g), and the whole was polymerized under a nitrogen atmosphere at 120° C. for 5 hours.

Styrene (108 g)
Ethyl p-styrenesulfonate (24.5 g)
2,2'-azobisisobutyronitrile (0.9 g)
TEMPO (0.8 g)
Dicumyl peroxide (0.3 g)

As a result, a copolymer (93 g) containing units represented by the following formula (L) at a content ratio (mol %) (M11):(F11) of 90:10 was obtained. The copolymer had a number average molecular weight Mn of 22,000 and a molecular weight distribution (Mw/Mn) of 1.30.

(L)

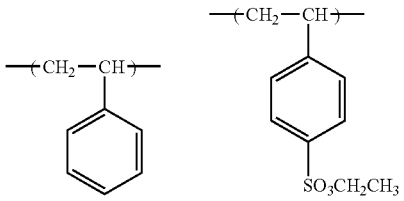

M11 F11

Example M

A copolymer represented by the following formula (M) was synthesized by employing nitroxide-mediated polymerization. Copolymerization was performed by following the same procedure as that of Example L with the exception that ethyl m-styrenesulfonate was used instead of ethyl p-styrenesulfonate of Example L. As a result, a copolymer (90 g) containing units represented by the following formula (M) at a content ratio (mol %) (M12):(F12) of 90:10 was obtained. The copolymer had a number average molecular weight Mn of 21,000 and a molecular weight distribution (Mw/Mn) of 1.28.

(M)

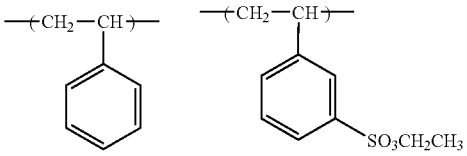

M12 F12

Example N

A copolymer represented by the following formula (N) was synthesized by employing nitroxide-mediated polymerization. Copolymerization was performed by following the same procedure as that of Example L with the exception that ethyl o-styrenesulfonate was used instead of ethyl p-styrenesulfonate of Example L. As a result, a copolymer (91 g) containing units represented by the following formula (N) at a content ratio (mol %) (M13):(F13) of 90:10 was obtained. The copolymer had a number average molecular weight Mn of 23,000 and a molecular weight distribution (Mw/Mn) of 1.29.

(N)

M13

F13

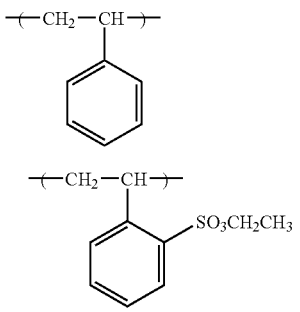

Example O

A copolymer represented by the following formula (O) was synthesized by employing atom transfer radical polymerization.

The following materials were dissolved in DMF (128 g), and the whole was polymerized under a nitrogen atmosphere at 70° C. for 7 hours.

Methyl methacrylate (100 g)

Methyl 4-ethenyl-1-naphthalenesulfonate (28 g)

Ethyl 2-bromoisobutyrate as an initiation seed (0.95 g)

Copper bromide as a catalyst (4.2 g)

Sparteine as a ligand (3.4 g)

As a result, a copolymer (96 g) containing units represented by the following formula (O) at a content ratio (mol %) (M14):(F14) of 90:10 was obtained. The copolymer had a number average molecular weight Mn of 21,000 and a molecular weight distribution (Mw/Mn) of 1.20.

(O)

M14

F14

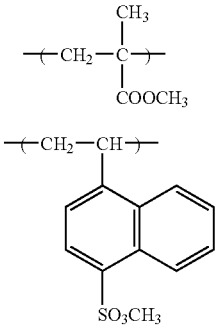

Example P

A copolymer represented by the following formula (P) was synthesized by employing atom transfer radical polymerization. Copolymerization was performed by following the same procedure as that of Example O with the exception that ethyl 4-ethenyl-1-naphthalenesulfonate was used instead of methyl 4-ethenyl-1-naphthalenesulfonate of Example O. As a result, a copolymer (99 g) containing units represented by the following formula (P) at a content ratio (mol %) (M15):(F15) of 90:10 was obtained. The copolymer had a number average molecular weight Mn of 23,000 and a molecular weight distribution (Mw/Mn) of 1.21.

(P)

M15

F15

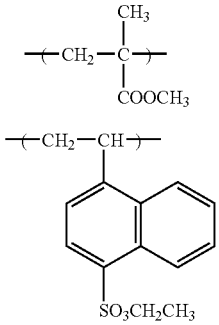

Example Q

A copolymer represented by the following formula (Q) was synthesized by employing nitroxide-mediated polymerization. The following materials were dissolved in DMF (130 g), and the whole was polymerized under a nitrogen atmosphere at 120° C. for 5 hours.

Styrene (108 g)

Ethyl 4-ethenyl-1-naphthalenesulfonate (17.4 g)

2,2'-azobisisobutyronitrile (0.9 g)

TEMPO (0.8 g)

Dicumyl peroxide (0.3 g)

As a result, a copolymer (94 g) containing units represented by the following formula (Q) at a content ratio (mol %) (M16):(F16) of 93:7 was obtained. The copolymer had a number average molecular weight Mn of 20,000 and a molecular weight distribution (Mw/Mn) of 1.21.

(Q)

M16

F16

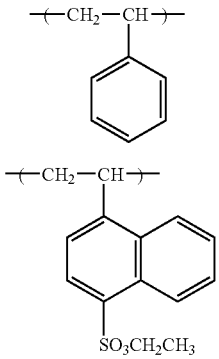

Example R

A copolymer represented by the following formula (R) was synthesized by employing atom transfer radical polymerization. Copolymerization was performed by following the same procedure as that of Example Q with the exception that methyl 4-ethenyl-1-naphthalenesulfonate was used instead of ethyl 4-ethenyl-1-naphthalenesulfonate of Example Q. As a result, a copolymer (92 g) containing units represented by the following formula (R) at a content ratio (mol %) (M17):(F17) of 93:7 was obtained. The copolymer had a number average molecular weight Mn of 19,000 and a molecular weight distribution (Mw/Mn) of 1.18.

(R)

M17

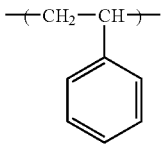

F17

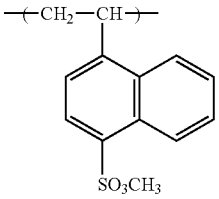

Example S

A block copolymer represented by the following formula (S) was synthesized by employing atom transfer radical polymerization. The following materials were dissolved in DMF (22 g), and the whole was polymerized under a nitrogen atmosphere at 70° C. for 1 hour.

Methyl p-styrenesulfonate (22 g)

1-bromoethyl benzene as an initiation seed (0.9 g)

Copper bromide as a catalyst (0.7 g)

1,1,4,7,10,10-hexamethyltriethylenetetramine as a ligand (1.1 g)

As a result, poly(methyl p-styrenesulfonate) (18 g, number average molecular weight Mn=3,500, molecular weight distribution (Mw/Mn)=1.15) as a macroinitiator was obtained.

Subsequently, the following materials were dissolved in DMF (125 g), and the whole was copolymerized under a nitrogen atmosphere at 70° C. for 5 hours.

Poly(methyl p-styrenesulfonate) as a macroinitiator (initiation seed) (18 g)

Styrene (104 g)

Copper bromide as a catalyst (2.1 g)

1,1,4,7,10,10-hexamethyltriethylenetetramine as a ligand (3.5 g)

As a result, a block copolymer (90 g) containing units represented by the following formula (S) at a content ratio (mol %) (M18):(F18) of 90:10 was obtained. The copolymer had a number average molecular weight Mn of 20,000 and a molecular weight distribution (Mw/Mn) of 1.21.

(S)

M18

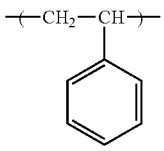

-continued

F18

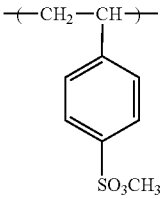

Example T

A block copolymer represented by the following formula (T) was synthesized by employing atom transfer radical polymerization. Copolymerization was performed by following the same procedure as that of Example S with the exception that methyl m-styrenesulfonate was used instead of methyl p-styrenesulfonate of Example S. As a result, a block copolymer (91 g) containing units represented by the following formula (T) at a content ratio (mol %) (M19):(F19) of 90:10 was obtained. The copolymer had a number average molecular weight Mn of 20,000 and a molecular weight distribution (Mw/Mn) of 1.20.

(T)

M19

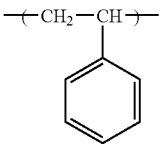

F19

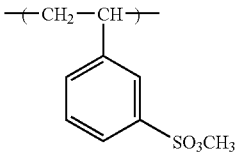

Example U

A block copolymer represented by the following formula (U) was synthesized by employing atom transfer radical polymerization. Copolymerization was performed by following the same procedure as that of Example S with the exception that methyl o-styrenesulfonate was used instead of methyl p-styrenesulfonate of Example S. As a result, a charge control agent comprised of a block copolymer (90 g) containing units represented by the following formula (U) at a content ratio (mol %) (M20):(F20) of 90:10 was obtained. The charge control agent had a number average molecular weight Mn of 22,000 and a molecular weight distribution (Mw/Mn) of 1.19.

(U)

M20

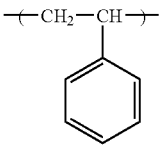

-continued

F20

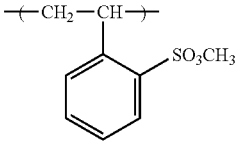

Example V

A block copolymer represented by the following formula (V) was synthesized by employing nitroxide-mediated polymerization. First, ethyl p-styrenesulfonate (25 g), 2,2'-azobisisobutyronitrile (1.0 g), TEMPO (1.0 g), and dicumyl peroxide (0.4 g) were dissolved in DMF (25 g), and the whole was polymerized under a nitrogen atmosphere at 120° C. for 1 hour. As a result, poly(ethyl p-styrenesulfonate) (20 g, number average molecular weight Mn=3,000, molecular weight distribution (Mw/Mn)=1.20) as a macroinitiator was obtained.

Subsequently, the following materials were dissolved in DMF (145 g), and the whole was copolymerized under a nitrogen atmosphere at 120° C. for 5 hours.

Poly(ethyl p-styrenesulfonate) as a macroinitiator (initiation seed) (20 g)

Styrene (124 g)

2,2'-azobisisobutyronitrile (1.0 g)

TEMPO (1.0 g)

Dicumyl peroxide (0.4 g)

As a result, a block copolymer (100 g) containing units represented by the following formula (V) at a content ratio (mol %) (M21):(F21) of 91:9 was obtained. The copolymer had a number average molecular weight Mn of 18,000 and a molecular weight distribution (Mw/Mn) of 1.24.

(V)

M21

F21

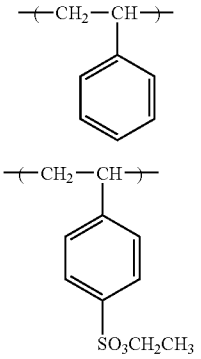

Example W

A block copolymer represented by the following formula (W) was synthesized by employing atom transfer radical polymerization. The following materials were dissolved in DMF (30 g), and the whole was polymerized under a nitrogen atmosphere at 70° C. for 1 hour.

Methyl 4-ethenyl-1-naphthalenesulfonate (28 g)

1-bromoethylbenzene as an initiation seed (0.7 g)

Copper bromide as a catalyst (0.5 g)

1,1,4,7,10,10-hexamethyltriethylenetetramine as a ligand (0.8 g)

As a result, poly(methyl 4-ethylene-1-naphthalenesulfonate) (22 g, number average molecular weight Mn=6,200, molecular weight distribution (Mw/Mn)=1.13) as a macroinitiator was obtained.

Subsequently, the following materials were dissolved in DMF (110 g), and the whole was copolymerized under a nitrogen atmosphere at 70° C. for 5 hours.

Methyl 4-ethylene-1-naphthalenesulfonate as a macroinitiator (initiation seed) (22 g)

Styrene (83 g)

Copper bromide as a catalyst (1.5 g)

1,1,4,7,10,10-hexamethyltriethylenetetramine as a ligand (2.4 g)

As a result, a block copolymer (84 g) containing units represented by the following formula (W) at a content ratio (mol %) (M22):(F22) of 88:12 was obtained. The copolymer had a number average molecular weight Mn of 25,000 and a molecular weight distribution (Mw/Mn) of 1.20.

(W)

M22

F22

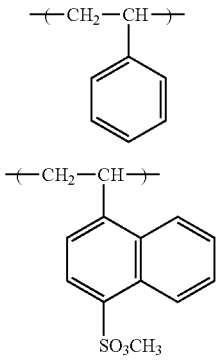

Example X

A block copolymer represented by the following formula (X) was synthesized by employing nitroxide-mediated polymerization. First, the following materials were dissolved in DMF (31 g), and the whole was polymerized under a nitrogen atmosphere at 120° C. for 1.5 hours.

Ethyl 4-ethenyl-1-naphthalenesulfonate (31 g)

2,2'-azobisisobutyronitrile (0.5 g)

TEMPO (0.5 g)

Dicumyl peroxide (0.2 g)

As a result, poly(ethyl 4-ethylene-1-naphthalenesulfonate) (25 g, number average molecular weight Mn=8,000, molecular weight distribution (Mw/Mn)=1.20) as a macroinitiator was obtained.

Subsequently, the following materials were dissolved in DMF (110 g), and the whole was polymerized under a nitrogen atmosphere at 120° C. for 6 hours.

Poly(ethyl 4-ethylene-1-naphthalenesulfonate) as a macroinitiator (initiation seed) (25 g)

Styrene (86 g)

2,2'-azobisisobutyronitrile (0.5 g)

TEMPO (0.5 g)

Dicumyl peroxide (0.2 g)

As a result, a block copolymer (88 g) containing units represented by the following formula (X) at a content ratio (mol %) (M23):(F23) of 87:13 was obtained. The copolymer had a number average molecular weight Mn of 30,000 and a molecular weight distribution (Mw/Mn) of 1.25.

(X)

M23

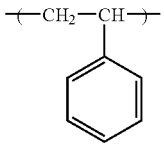

F23

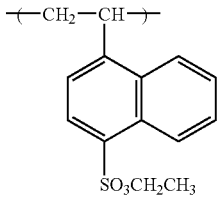

Example Y-1

(2-bromoethyl)benzene (100 g) was stirred in an ice bath while fuming sulfuric acid (40 g) was slowly added dropwise. After the dropwise addition, the mixture was stirred at 0° C. for 20 hours.

As a result, a mixture of 2-(2-bromoethyl)benzenesulfonic acid, 3-(2-bromoethyl)benzenesulfonic acid, and 4-(2-bromoethyl)benzenesulfonic acid was obtained, and the mixture was separated and purified with a silica gel column.

Next, 2-(2-bromoethyl)benzenesulfonic acid (10 g) was slowly added dropwise to a 1-mol/L aqueous solution of sodium hydroxide (100 mL), and the whole was stirred for 1 hour at room temperature. After that, the resultant was refluxed for 4 hours, and was then subjected to a dehydrobromination reaction, whereby sodium o-styrenesulfonate was obtained.

Next, sodium o-styrenesulfonate was desalted by using an ion-exchange resin. At that time, methyl o-styrenesulfonate was synthesized with reference to SYNTHETIC COMMUNICATIONS, 15(12), 21, 1057-1062 (1985).

Under nitrogen flow, the desalted product of sodium o-styrenesulfonate (5 g), trimethyl orthoformate (50 mL), and p-benzoquinone as a polymerization inhibitor were put into a flask, and the whole was heated at 70° C. for 5 hours. The reaction mixture was cooled and concentrated under reduced pressure. The resultant was washed with 3 L of water twice and then with 3 L of hexane twice. Then, the resultant was redissolved in chloroform and dried with anhydrous magnesium sulfate to evaporate the solvent.

The structure of the resultant compound was identified by $^1$H-NMR. It was confirmed that the sulfonic acid turned into methyl sulfonate because a peak derived from methyl sulfonate was observed at 3 to 4 ppm. Further, it was confirmed that the sulfonic acid turned into methyl sulfonate also because no equivalence point derived from the sulfonic acid was observed in oxidation titration using a potentiometric titration apparatus.

Example Y-2

3-(2-bromoethyl)benzenesulfonic acid obtained in Example Y-1 was subjected to dehydrobromination by following the same procedure as in Example Y-1, whereby sodium m-styrenesulfonate was obtained.

Next, the desalted product of sodium m-styrenesulfonate was subjected to methyl esterification with trimethyl orthoformate by following the same procedure as in Example Y-1, whereby methyl m-styrenesulfonate was obtained.

Example Z-1

1-(2-bromoethyl)naphthalene (120 g) was stirred in an ice bath while fuming sulfuric acid (50 g) was slowly added dropwise. After the dropwise addition, the mixture was stirred at 0° C. for 24 hours, whereby 4-(2-bromoethyl)naphthalenesulfonic acid was obtained.

Next, 4-(2-bromoethyl)naphthalenesulfonic acid (10 g) was slowly added dropwise to a 1-mol/L aqueous solution of sodium hydroxide (100 mL), and the whole was stirred for 1 hour at room temperature. After that, the resultant was refluxed for 6 hours, and was then subjected to a dehydrobromination reaction, whereby sodium 4-ethenylnaphthalenesulfonate was obtained.

Next, sodium 4-ethenylnaphthalenesulfonate was desalted by using an ion-exchange resin, and was then subjected to methyl esterification by following the same procedure as in Example Y-1, whereby methyl 4-ethenylnaphthalenesulfonate was synthesized.

Example Z-2

2-(2-bromoethyl)naphthalene (120 g) was stirred in an ice bath while fuming sulfuric acid (50 g) was slowly added dropwise. After the dropwise addition, the mixture was stirred at 0° C. for 30 hours, whereby 2-(2-bromoethyl)naphthalenesulfonic acid and a plurality of isomers were obtained, and then separated and purified.

Next, 2-(2-bromoethyl)naphthalenesulfonic acid (5 g) was slowly added dropwise to a 1-mol/L aqueous solution of sodium hydroxide (50 mL), and the whole was stirred for 1 hour at room temperature. After that, the resultant was refluxed for 6 hours, and was then subjected to a dehydrobromination reaction, whereby sodium 2-ethenylnaphthalenesulfonate was obtained.

Next, sodium 2-ethenylnaphthalenesulfonate was desalted by using an ion-exchange resin, and was then subjected to methyl esterification by following the same procedure as in Example Z-1, whereby methyl 2-ethenylnaphthalenesulfonate was synthesized.

Next, various toners were produced by using charge control agents produced by means of methods selected from the methods of the present invention, and were evaluated (Examples 1 to 34).

Example 1

First, an aqueous solution of $Na_3PO_4$ was added to a 2-L four-necked flask equipped with a high-speed stirrer TK Homomixer (trade name; manufactured by PRIMIX Corporation). The rotation frequency was adjusted to 10,000 rpm, and the solution was heated to 60° C. An aqueous solution of $CaCl_2$ was gradually added to the solution to prepare an aqueous dispersion medium containing a minute, slightly water-soluble dispersant $Ca_3(PO_4)_2$. Meanwhile, the following components were dispersed for 3 hours by using a ball mill. Then, 10 parts by mass of a releasing agent (i.e., carnauba wax having melting point of 83° C.) and 10 parts by mass of 2,2'-azobis(2,4-dimethylvaleronitrile) as a polymerization initiator were added to prepare a polymerizable monomer composition.

Styrene monomer: 82 parts by mass

Ethylhexyl acrylate monomer: 18 parts by mass

Divinylbenzene monomer: 0.1 part by mass

Cyan colorant (C.I. Pigment Blue 15): 6 parts by mass

Polyethylene oxide resin (having a molecular weight of 3,200 and an acid value of 8): 5 parts by mass Exemplified Compound A: 2 parts by mass Next, the polymerizable monomer composition thus obtained was charged into the aqueous dispersion medium prepared in advance, and the whole was granulated while the rotational frequency was kept at 10,000 rpm. After that, the resultant was allowed to react at 65° C. for 3 hours while being stirred with a paddle mixer. Then, the resultant was polymerized at 80° C. for 6 hours to complete the polymerization reaction. After the completion of the reaction, the suspension was cooled, and an acid was added to dissolve the slightly water-soluble dispersant $Ca_3(PO_4)_2$. Then, the resultant was filtered, washed with water, and dried to give blue polymerized particles (1). The grain size of the resultant blue polymerized particles (1) was measured by means of a Multisizer COULTER COUNTER (trade name; manufactured by Beckman Coulter, Inc.), with the result that the weight average particle size was 7.0 μm and the amount of fine powder (existence percentage of particles of 3.17 μm or less in number distribution) was 5.1% by number.

1.3 parts by mass of hydrophobic silica fine powder treated with hexamethyldisilazane (BET: 270 $m^2/g$) as a fluidity improver were dry-mixed with and externally added to 100 parts by mass of the blue polymerized particles (1) thus prepared by using a Henschel mixer, to thereby produce a blue toner (1) of this example. Further, 7 parts by mass of the blue toner (1) and 93 parts by mass of a resin-coated magnetic ferrite carrier (average particle size: 45 μm) were mixed to prepare a two-component blue developer (1) for magnetic brush development.

Examples 2 to 5

Each of blue toners (2) to (5) of Examples 2 to 5 was produced by following the same procedure as in Example 1 with the exception that Exemplified Compound A was changed to each of Exemplified Compounds F, K, P, and U. The characteristics of the respective toners were measured in the same manner as in Example 1. Table 1 shows the results. In addition, the toners were used, respectively, to prepare two-component blue developers (2) to (5) of Examples 2 to 5 in the same manner as in Example 1.

Comparative Example 1

A blue toner (6) of Comparative Example 1 was produced by following the same procedure as in Example 1 with the exception that no exemplified compound was used. The characteristics of the toner were measured in the same manner as in Example 1. Table 1 shows the results. In addition, the toner was used to prepare a two-component blue developer (6) of Comparative Example 1 in the same manner as in Example 1.

<Evaluation>

The charge quantity of toner of each of the two-component blue developers (1) to (5) prepared in Examples 1 through 5 and the two-component blue developer (6) prepared in Comparative Example 1 was measured. To be specific, the charge quantity of toner after stirring for 10 sec and 300 sec under normal-temperature and normal-humidity conditions (25° C.; 60% RH) and under high-temperature and high-humidity conditions (30° C.; 80% RH) were measured, respectively, by the above-mentioned method of measuring a charge quantity. Then, the measured value of two-component blow-off charge quantity was rounded to one decimal place, and the resultant value was evaluated according to the following criteria. Table 1 summarizes the results.

<Charging Property>

□: Extremely good (−20 μC/g or less)

○: Good (−19.9 to −10.0 μC/g)

Δ: Practicable (−9.9 to −5.0 μC/g)

x: Not practicable (−4.9 μC/g or more)

Examples 6 to 10

Each of yellow toners (1) to (5) of Examples 6 to 10 was produced by following the same procedure as in Example 1 with the exception that 2.0 parts by mass of each of Exemplified Compounds B, G, M, Q, and V were used; and a yellow colorant (Hansa yellow G) was used instead of the cyan colorant. The characteristics of the toners were measured in the same manner as in Example 1. Table 1 shows the results. In addition, the toners were used to prepare two-component yellow developers (1) to (5) in the same manner as in Example 1.

Comparative Example 2

A yellow toner (6) of Comparative Example 2 was produced by following the same procedure as in Example 1 with the exception that no exemplified compound was used and a yellow colorant (Hansa yellow G) was used instead of the cyan colorant. The characteristics of the toner were measured in the same manner as in Example 1. Table 1 shows the results. In addition, the toner was used to prepare a two-component yellow developer (6) of Comparative Example 2 in the same manner as in Example 1.

<Evaluation>

The charge quantity of toner of each of the two-component yellow developers (1) to (5) prepared in Examples 7 to 12 and the two-component yellow developer (6) prepared in Comparative Example 2 was measured and evaluated in the same manner as in Example 1. Table 1 summarizes the results.

Examples 11 to 15

Each of black toners (1) to (5) of Examples 11 to 15 was produced by following the same procedure as in Example 1 with the exception that 2.0 parts by mass of each of Exemplified Compounds C, H, L, R, and W were used and carbon black (DBP oil absorption: 110 mL/100 g) was used instead of the cyan colorant.

The characteristics of the toners were measured in the same manner as in Example 1. Table 1 shows the results. In addition, the toners were used to prepare two-component black developers (1) to (5) in the same manner as in Example 1.

Comparative Example 3

A black toner (6) of Comparative Example 3 was produced by following the same procedure as in Example 1 with the exception that no exemplified compound was used and carbon black (DBP oil absorption: 110 mL/100 g) was used instead of the cyan colorant. The characteristics of the toner were measured in the same manner as in Example 1. Table 1 shows the results. In addition, the toner was used to prepare a two-component black developer (6) of Comparative Example 3 in the same manner as in Example 1.

<Evaluation>

The charge quantity of toner of each of the two-component black developers (1) to (5) prepared in Examples 11 to 15 and the two-component black developer (6) prepared in Comparative Example 3 was measured and evaluated in the same manner as in Example 1. Table 1 summarizes the results.

Example 16

Styrene-butyl acrylate copolymer resin (having a glass transition temperature of 70° C.): 100 parts by mass Magenta pigment (C.I. Pigment Red 114): 5 parts by mass Wax (low molecular polyethylene having a melting point of 94° C.): 7 parts by mass Exemplified Compound D: 2 parts by mass The above-mentioned components were mixed, and the mixture was melted and kneaded by means of a biaxial extruder (L/D=30). The kneaded product was cooled, roughly pulverized by means of a hammer mill, and finely pulverized by means of a jet mill. After that, the finely pulverized product was classified to give magenta colored particles (1) by a pulverization method. The grain size of the magenta colored particles (1) was measured. The particles had a weight average particle size of 7.1 μm and an amount of fine powder of 5.1% by number.

1.5 parts by mass of hydrophobic silica fine powder treated with hexamethyldisilazane (BET: 250 $m^2/g$) as a fluidity improver were dry-mixed with 100 parts by mass of the magenta colored particles (1) by using a Henschel mixer, to thereby produce a magenta (red) toner (1) of this example. Further, 7 parts by mass of the resultant magenta (red) toner (1) and 93 parts by mass of a resin-coated magnetic ferrite carrier (average particle size: 45 μm) were mixed to prepare a two-component magenta (red) developer (1) for magnetic brush development.

Examples 17 to 20

Each of magenta (red) toners (2) to (5) of Examples 17 to 20 was produced by following the same procedure as in Example 16 with the exception that Exemplified Compound D was changed to each of Exemplified Compounds I, N, S, and X. The characteristics of the toners were measured in the same manner as in Example 1. Table 1 shows the results. In addition, the toners were used to prepare two-component magenta (red) developers (2) to (5) of Examples 17 to 20 in the same manner as in Example 16.

Comparative Example 4

A magenta (red) toner (6) of Comparative Example 4 was produced by following the same procedure as in Example 16 with the exception that no exemplified compound was used. The characteristics of the toner were measured in the same manner as in Example 1. Table 1 shows the results. In addition, the toner was used to prepare a two-component magenta (red) developer (6) of Comparative Example 4 in the same manner as in Example 16.

<Evaluation>

The charge quantity of toner of each of the two-component magenta (red) developers (1) to (5) prepared in Examples 16 to 20 and the two-component magenta (red) developer (6) prepared in Comparative Example 4 were measured and evaluated in the same manner as in Example 1. Table 1 summarizes the results.

Example 21

Polyester resin: 100 parts by mass

Carbon black (DBP oil absorption 110 mL/100 g): 5 parts by mass

Wax (low molecular polyethylene having a melting point of 94° C.): 7 parts by mass Exemplified Compound E: 2 parts by mass A polyester resin was synthesized as described below. 751 parts of propylene oxide 2-mole adduct of bisphenol A, 104 parts of terephthalic acid, and 167 parts of trimellitic anhydride were subjected to polycondensation by using 2 parts of dibutyltin oxide as a catalyst to produce the polyester resin having a softening point of 125° C.

The above-mentioned components were mixed, and the mixture was melted and kneaded by means of a biaxial extruder (L/D=30). The kneaded product was cooled, roughly pulverized by means of a hammer mill, and finely pulverized by means of a jet mill. After that, the finely pulverized product was classified to give black colored particles (7) by a pulverization method. The grain size of the black colored particles (7) was measured. The particles had a weight average particle size of 7.3 μm and an amount of fine powder of 5.1% by number.

1.5 parts by mass of hydrophobic silica fine powder treated with hexamethyldisilazane (BET: 250 $m^2/g$) as a fluidity improver were dry-mixed with 100 parts by mass of the black colored particles (7) by using a Henschel mixer, to thereby produce a black toner (7) of this example. Further, 7 parts by mass of the resultant black toner (7) and 93 parts by mass of a resin-coated magnetic ferrite carrier (average particle size: 45 μm) were mixed to prepare a two-component black developer (7) for magnetic brush development.

Examples 22 to 24

Each of black toners (8) to (10) of Examples 22 to 24 was produced by following the same procedure as in Example 21 with the exception that Exemplified Compound E was changed to each of Exemplified Compounds J, O, and T. The characteristics of the toners were measured in the same manner as in Example 1. Table 1 shows the results. In addition, the toners were used to prepare two-component black developers (8) to (10) of Examples 22 to 24 in the same manner as in Example 21.

Comparative Example 5

A black toner (11) of Comparative Example 5 was produced by following the same procedure as in Example 21 with the exception that no exemplified compound was used. The characteristics of the toner were measured in the same manner as in Example 1. Table 1 shows the results. In addition, the toner was used to prepare a two-component black developer (11) of Comparative Example 5 in the same manner as in Example 21.

<Evaluation>

The charge quantity of toner of each of the two-component black developers (7) to (10) prepared in Examples 21 to 24 and the two-component black developer (11) prepared in Comparative Example 5 was measured and evaluated in the same manner as in Example 1. Table 1 summarizes the results.

TABLE 1

| Example | Exemplified Compound No. | Toner No. | Particle Size Distribution: Average particle diameter (μm) | Particle Size Distribution: Amount of fine powder (%) | Charging Property: Normal temperature and normal humidity (Q/M) 10 Sec | Charging Property: Normal temperature and normal humidity (Q/M) 300 Sec | Charging Property: High temperature and high humidity (Q/M) 10 Sec | Charging Property: High temperature and high humidity (Q/M) 300 Sec |
|---|---|---|---|---|---|---|---|---|
| 1 | A | Blue 1 | 7.0 | 5.1 | □ | □ | □ | □ |
| 2 | F | Blue 2 | 7.1 | 5.0 | □ | □ | □ | □ |
| 3 | K | Blue 3 | 7.3 | 5.2 | □ | □ | □ | □ |
| 4 | P | Blue 4 | 7.1 | 5.1 | □ | □ | □ | □ |
| 5 | U | Blue 5 | 7.0 | 4.9 | □ | □ | □ | □ |
| 6 | B | Yellow 1 | 7.3 | 5.2 | □ | □ | □ | □ |
| 7 | G | Yellow 2 | 7.1 | 5.0 | □ | □ | □ | □ |
| 8 | M | Yellow 3 | 7.2 | 5.1 | □ | □ | □ | □ |
| 9 | Q | Yellow 4 | 6.9 | 5.0 | □ | □ | □ | □ |
| 10 | V | Yellow 5 | 7.1 | 5.2 | □ | □ | □ | □ |
| 11 | C | Black 1 | 7.0 | 5.0 | □ | □ | □ | □ |
| 12 | H | Black 2 | 7.2 | 5.1 | □ | □ | □ | □ |
| 13 | L | Black 3 | 7.3 | 5.2 | □ | □ | □ | □ |
| 14 | R | Black 4 | 6.9 | 5.0 | □ | □ | □ | □ |

| | Exemplified Compound No. | Toner No. | Particle Size Distribution: Average particle size (μm) | Particle Size Distribution: Amount of fine powder (%) | Charging Property: Normal temperature and normal humidity (Q/M) 10 Sec | Charging Property: Normal temperature and normal humidity (Q/M) 300 Sec | Charging Property: High temperature and high humidity (Q/M) 10 Sec | Charging Property: High temperature and high humidity (Q/M) 300 Sec |
|---|---|---|---|---|---|---|---|---|
| Example | | | | | | | | |
| 15 | W | Black 5 | 7.0 | 5.2 | □ | □ | □ | □ |
| 16 | D | Red 1 | 7.1 | 5.1 | □ | □ | □ | □ |
| 17 | I | Red 2 | 7.2 | 5.2 | □ | □ | □ | □ |
| 18 | N | Red 3 | 7.0 | 5.1 | □ | □ | □ | □ |
| 19 | S | Red 4 | 7.1 | 5.2 | □ | □ | □ | □ |
| 20 | X | Red 5 | 7.2 | 5.0 | □ | □ | □ | □ |
| 21 | E | Black 7 | 7.3 | 5.1 | □ | □ | □ | □ |
| 22 | J | Black 8 | 7.1 | 5.0 | □ | □ | □ | □ |
| 23 | O | Black 9 | 7.3 | 5.2 | □ | □ | □ | □ |
| 24 | T | Black 10 | 7.0 | 5.1 | □ | □ | □ | □ |
| Comparative Example | | | | | | | | |
| 1 | — | Blue 6 | 7.2 | 5.0 | x | Δ | x | x |
| 2 | — | Yellow 6 | 7.1 | 5.0 | x | Δ | x | Δ |
| 3 | — | Black 6 | 7.2 | 5.2 | x | Δ | x | x |
| 4 | — | Red 6 | 7.0 | 5.0 | x | Δ | x | x |
| 5 | — | Black 11 | 7.2 | 5.2 | x | x | x | x |

(For convenience of description, yellow is referred to as yellow and magenta is referred to as red.)

Examples 25 to 30 and Comparative Examples 6 to 10

First, as an image forming apparatus used for an image forming method of each of Examples 25 to 30 and Comparative Examples 6 to 10, LBP5500 (trade name; manufactured by CANON Inc.) was used.

At that time, a yellow toner, a magenta toner, a cyan toner, or a black toner prepared in Examples 1, 6, 11, 16, 21, and 24 and Comparative Examples 1 to 5 were each used as a developer to form toner image.

<Evaluation>

While consecutively supplying the toner, a printout test was performed in a monochrome intermittent mode (that is, a mode in which a developing unit is suspended for 10 sec each time one sheet is printed out, and degradation of toner is accelerated by a preliminary operation at the time of restart). LBP5500 was modified so that the printout was performed under normal-temperature and normal-humidity conditions (25° C.; 60% RH) and under high-temperature and high-humidity conditions (30° C.; 80% RH) at a printout rate of 8 sheets (A4 size)/min. The toners of Examples 1, 6, 11, 16, 21, and 24 and the toners of Comparative Examples 1 to 5 were used. The resultant printout image was evaluated for the following items. Table 2 summarizes the results of the evaluation.

<Printout Image Evaluation>

1. Image Density

Printout on a predetermined number of sheets of ordinary plain paper for a copying machine (75 g/m$^2$) was performed. The image density was evaluated in terms of the degree of maintenance of image density of an image at the time of completion of printing as compared to an initial image. The relative density with respect to a density of a printout image of a white portion having an original density of 0.00 was measured by using a Macbeth reflection densitometer (manufactured by Gretag Macbeth), and was used for evaluation.

□: Excellent (The image density at the time of completion is 1.40 or more.)

○: Good (The image density at the time of completion is 1.35 or more and less than 1.40.)

Δ: Acceptable (The image density at the time of completion is 1.00 or more and less than 1.35.)

x: Not acceptable (The image density at the time of completion is less than 1.00.)

2. Image Fog

Printout on a predetermined number of sheets of ordinary plain paper for a copying machine (75 g/m$^2$) was performed. A solid white image at the time of completion of printing was evaluated. The image was evaluated by the following method. Measurement was performed by using a reflection densitometer (REFLECTOMETER MODEL TC-6DS (trade name); manufactured by TOKYO DENSHOKU CO., LTD.). Specifically, the lowest value of measured reflection densities of white portion after printing was defined as Ds; an average value of reflection densities of paper sheets before printing was defined as Dr; (Ds−Dr) was determined from these values; and the resultant value was defined as amount of fogging, which was evaluated according to the following criteria.

□: Extremely good (The amount of fogging is 0% or more and less than 1.5%.)

○: Good (The amount of fogging is 1.5% or more and less than 3.0%.)

Δ: Practicable (The amount of fogging is 3.0% or more and less than 5.0%.)

x: Not practicable (The amount of fogging is 5.0% or more.)

3. Transfer Property

Solid black images were printed out on a predetermined number of sheets of ordinary plain paper for a copying machine (75 g/m$^2$). The amount of blank area in output image at the time of completion of printing was visually observed, and was evaluated according to the following criteria.

□: Extremely good (Substantially no occurrence of blank area)

○: Good (Slightly occurred)

Δ: Practicable x: Not practicable

In addition, in each of Examples 25 to 30 and Comparative Examples 6 to 10, the states of occurrence of: flaws on the surfaces of a photosensitive drum and an intermediate transfer member; and retention of residual toner to the surfaces, and influences of the flaws and adhered residual toner on a printout image (i.e., matching with an image forming apparatus) when image output on 5,000 paper sheets had been performed were visually evaluated.

In a system using each of the toners of Examples 25 to 30, neither flaw on the surfaces of the photosensitive drum and the intermediate transfer member nor retention of the toner to the surfaces was observed, so that matching with LBP5500 was extremely good.

On the other hand, in a system using each of the toners of Comparative Examples 6 to 10, retention of the toner to the surface of the photosensitive drum was observed. Further, in the system using each of the toners of Comparative Examples 6 to 10, retention of the toner to the surface of the intermediate transfer member and a flaw formed on the surface were observed, and a vertical linear image defect on a printout image occurred, which were problems in matching with LBP5500.

TABLE 2

| | | Normal Temperature and Normal Humidity | | | High Temperature and High Humidity | | |
|---|---|---|---|---|---|---|---|
| | Toner | Image density | Image fog | Transfer properties | Image density | Image fog | Transfer properties |
| Example | | | | | | | |
| 25 | Blue 1 | □ | □ | □ | □ | □ | □ |
| 26 | Yellow 1 | □ | □ | □ | □ | □ | □ |
| 27 | Black 1 | □ | □ | □ | □ | □ | □ |
| 28 | Red 1 | □ | □ | □ | □ | □ | □ |
| 29 | Black 7 | □ | □ | □ | □ | □ | □ |
| 30 | Black 10 | □ | □ | □ | □ | □ | □ |
| Comparative Example | | | | | | | |
| 6 | Blue 6 | Δ | x | x | x | x | x |
| 7 | Yellow 6 | Δ | x | x | Δ | x | x |
| 8 | Black 6 | Δ | x | x | Δ | x | x |
| 9 | Red 6 | Δ | Δ | x | x | x | x |
| 10 | Black 11 | Δ | x | x | x | x | x |

Examples 31 to 33 and Comparative Examples 11 to 13

In performing an image forming method of each of Examples 31 to 33 and Comparative Examples 11 to 13, each of the toners produced in Examples 1, 6, and 11 and Comparative Examples 1 to 3 was used as a developer. Further, as means for forming an image, there was used LBP5500 which was modified by attaching a reuse mechanism (i.e., system for utilizing collected toner) and then reset.

In this state, printout on up to 30,000 sheets was carried out in a continuous mode (that is, a mode in which consumption of toner is accelerated without suspending a developing unit) in a normal-temperature and normal-humidity (25° C.; 60%

RH) environment at a printout rate of 8 sheets (A4 size)/min while sequentially supplying the toner.

The image densities of the resultant printout images were measured, and the durability thereof was evaluated according to the following criteria. In addition, an image on 10,000th sheet was observed and evaluated for image fog according to the following criteria.

Moreover, at the same time, the state of respective devices constituting LBP5500 after the durability test was observed to evaluate matching between the respective devices and each of the above-mentioned toners. Table 3 summarizes the results of the evaluation.

<Transition of Image Density in Durability Test>

Printout on a predetermined number of sheets of ordinary plain paper for a copying machine (75 g/m$^2$) was performed. The image density was evaluated in terms of the degree of maintenance of image density of an image at the time of completion of printing as compared to an initial image. The relative density with respect to a density of a printout image of a white portion having an original density of 0.00 was measured by using a Macbeth reflection densitometer (manufactured by Gretag Macbeth), and was used for evaluation.

□: Excellent (The image density at the time of completion is 1.40 or more.)

○: Good (The image density at the time of completion is 1.35 or more and less than 1.40.)

Δ: Acceptable (The image density at the time of completion is 1.00 or more and less than 1.35.)

x: Not acceptable (The image density at the time of completion is less than 1.00.)

<Image Fog>

Printout on a predetermined number of sheets of ordinary plain paper for a copying machine (75 g/m$^2$) was performed and a solid white image at the time of completion of printing was evaluated. The evaluation was made by following the above described method using a reflection densitometer (REFLECTOMETER MODEL TC-6DS (trade name); manufactured by TOKYO DENSHOKU CO., LTD.).

Δ: Practicable (Retention occurred, but influence on image was small.)

x: Not practicable (Retention occurred remarkably, and image unevenness was large.)

2. Match Between Toner and Photosensitive Drum

The state of occurrence of: a flaw on the surface of a photosensitive drum; and retention of residual toner to the surface, and the influence of the flaw and residual toner on a printout image were visually evaluated.

□: Extremely good (Neither flaw nor retention occurred.)

○: Good (A slight flaw occurred but had no influence on an image.)

Δ: Practicable (Retention and flaw(s) occurred, but influence on an image was small.)

x: Not practicable (Retention occurred remarkably and a vertical linear image defect occurred.)

3. Matching with Fixing Equipment

The state of a surface of a fixing film was observed, and an overall average was calculated from the results of surface quality and the state of retention of residual toner to the surface, thereby evaluating the durability thereof.

(1) Surface Quality

The state of occurrence of a flaw or shaving on the surface of the fixing film after the completion of the printout test was visually observed and evaluated.

□: Extremely good (No occurrence)

○: Good (Almost no occurrence)

Δ: Practicable x: Not practicable (2) State of Retention of Residual Toner

The state of retention of residual toner on the surface of the fixing film after the completion of the printout test was visually observed and evaluated.

□: Extremely good (No occurrence)

○: Good (Almost no occurrence)

Δ: Practicable x: Not practicable

TABLE 3

| | | Printout Image Evaluation | | | | | Evaluation of Match between Toner and Equipment | | | |
|---|---|---|---|---|---|---|---|---|---|---|
| | | Transition of image density in durability test | | | | Image fog | | Photo-sensitive drum | Fixing equipment | |
| | Toner | Initial printout | 1,000th printout | 10,000th printout | 30,000th printout | 10,000th printout | Developing sleeve | | Surface quality | Retention of toner |
| Example | | | | | | | | | | |
| 31 | Blue 1 | □ | □ | □ | □ | □ | □ | □ | □ | □ |
| 32 | Yellow 1 | □ | □ | □ | □ | □ | □ | □ | □ | □ |
| 33 | Black 1 | □ | □ | □ | □ | □ | □ | □ | □ | □ |
| Comparative Example | | | | | | | | | | |
| 11 | Blue 6 | Δ | Δ | x | x | x | x | x | x | x |
| 12 | Yellow 6 | Δ | Δ | x | x | x | x | x | x | x |
| 13 | Black 6 | Δ | Δ | x | x | x | x | x | x | x |

<Evaluation of Matching with Image Forming Apparatus>

1. Match Between Toner and Developing Sleeve

After the completion of the printout test, the state of retention of residual toner to the surface of a developing sleeve and the influence of the adhered residual toner on a printout image were visually evaluated.

□: Extremely good (No retention occurred.)

○: Good (Almost no retention occurred.)

Example 34

The same procedure as in Example 31 was followed with the exception that LBP5500 was further modified so as to detach the toner reuse mechanism therefrom and also to provide a printout rate of 16 sheets (A4 size)/min.

A printout test was performed in a continuous mode (that is, a mode in which consumption of toner is accelerated without suspending the developing unit) while the blue toner (1) of Example 1 was sequentially supplied. The resultant printout image and matching with LBP5500 were evaluated for the same items as those of Examples 31 to 33 and Comparative Examples 11 to 13. As a result, good results were obtained for all of the items.

The present invention can be applied to, for example, a charge control agent contained in toner used for electrophotography technique.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2005-328165, filed Nov. 11, 2005, which is hereby incorporated by reference herein in its entirety.

What is claimed is:

1. A toner for developing electrostatic latent images, comprising:

a binder resin;

a colorant; and a charge control agent for controlling a charging state of fine particles, comprising a polymer having a unit represented by the chemical formula (8):

(8)

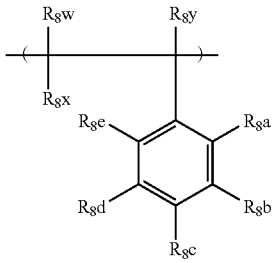

wherein $R_{8w}$ and $R_{8x}$ are each independently a halogen atom or a hydrogen atom, $R_{8y}$ is a $CH_3$ group or a hydrogen atom, $R_{8a}$, $R_{8b}$, $R_{8c}$, $R_{8d}$, and $R_{8e}$ are each independently $SO_3R_{8f}$ wherein $R_{8f}$ is a linear or branched alkyl group having 1 to 8 carbon atoms, a substituted or unsubstituted aromatic ring structure, or a substituted or unsubstituted heterocyclic ring structure, a hydrogen atom, a linear or branched alkyl group having 1 to 8 carbon atoms, or a linear or branched alkoxyl group having 1 to 8 carbon atoms, and at least one of $R_{8a}$, $R_{8b}$, $R_{8c}$, $R_{8d}$, and $R_{8e}$ is $SO_3R_{8f}$.

2. A toner for developing electrostatic latent images, comprising:

a binder resin;

a colorant; and a charge control agent for controlling a charging state of fine particles, comprising a polymer having a unit represented by the chemical formula (9):

(9)

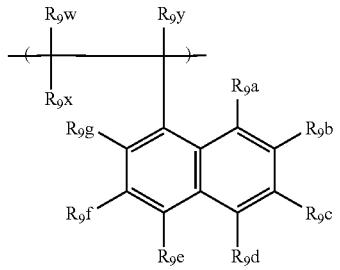

wherein $R_{9w}$ and $R_{9x}$ are each independently a halogen atom or a hydrogen atom, $R_{9y}$ is a $CH_3$ group or a hydrogen atom, $R_{9a}$, $R_{9b}$, $R_{9c}$, $R_{9d}$, $R_{9e}$, $R_{9f}$, and $R_{9g}$ are each independently $SO_3R_{9h}$ wherein $R_{9h}$ is a hydrogen atom, a linear or branched alkyl group having 1 to 8 carbon atoms, a substituted or unsubstituted aromatic ring structure, or a substituted or unsubstituted heterocyclic ring structure, a hydrogen atom, a linear or branched alkyl group having 1 to 8 carbon atoms, or a linear or branched alkoxyl group having 1 to 8 carbon atoms, and at least one of $R_{9a}$, $R_{9b}$, $R_{9c}$, $R_{9d}$, $R_{9e}$, $R_{9f}$, and $R_{9g}$ is $SO_3R_{9h}$.

3. A toner for developing electrostatic latent images, comprising:

a binder resin;

a colorant; and a charge control agent for controlling a charging state of fine particles, comprising a polymer having a unit represented by the chemical formula (10):

(10)

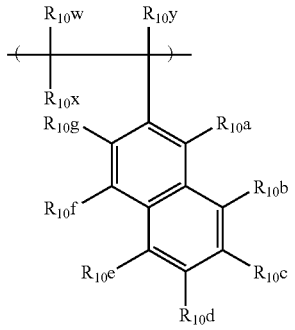

wherein $R_{10w}$ and $R_{10x}$ are each independently a halogen atom or a hydrogen atom, $R_{10y}$ is a $CH_3$ group or a hydrogen atom, $R_{10a}$, $R_{10b}$, $R_{10c}$, $R_{10d}$, $R_{10e}$, $R_{10f}$, and $R_{10g}$ are each independently $SO_3R_{10h}$ wherein $R_{10h}$ is a hydrogen atom, a linear or branched alkyl group having 1 to 8 carbon atoms, a substituted or unsubstituted aromatic ring structure, or a substituted or unsubstituted heterocyclic ring structure, a hydrogen atom, a linear or branched alkyl group having 1 to 8 carbon atoms, or a linear or branched alkoxyl group having 1 to 8 carbon atoms, and at least one of $R_{10a}$, $R_{10b}$, $R_{10c}$, $R_{10d}$, $R_{10e}$ $R_{10f}$, and, $R_{10g}$ is independently $SO_3R_{10h}$.

4. The toner of any one of claims 1-3, wherein the charge control agent comprises a copolymer having a unit derived from a vinyl monomer represented by the chemical formula (11):

(11)

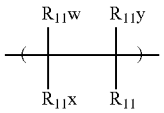

wherein $R_{11w}$ and $R_{11x}$ are each independently a halogen atom or a hydrogen atom, $R_{11y}$ is a $CH_3$ group, a halogen atom, or a hydrogen atom, $R_{11}$ is a hydrogen atom, a substituted or unsubstituted aliphatic hydrocarbon structure, a substituted or unsubstituted aromatic ring structure, a substituted or unsubstituted heterocyclic ring structure, a halogen atom, —CO—$R_{11a}$, —O—$R_{11b}$, —COO—$R_{11c}$, —OCO—$R_{11d}$, —CONR$_{11e}$R$_{11f}$, —CN, or a ring structure containing an N atom, and $R_{11a}$, $R_{11b}$, $R_{11c}$, $R_{11d}$, $R_{11e}$, and $R_{11f}$ are each independently a hydrogen atom, a substituted or unsubstituted aliphatic hydrocarbon structure, a substituted or unsubstituted aromatic ring structure, or a substituted or unsubstituted heterocyclic ring structure.

5. The toner of any one of claims 1-3, wherein the polymer has a molecular weight distribution (weight average molecular weight/number average molecular weight=Mw/Mn) satisfying a relationship of 1<Mw/Mn<2.

6. The toner of claim 4, wherein the copolymer comprises a block copolymer.

* * * * *